US009274443B2

(12) United States Patent
Tomono et al.

(10) Patent No.: US 9,274,443 B2
(45) Date of Patent: Mar. 1, 2016

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Hiroyuki Tomono, Numazu (JP); Kunihiko Sekido, Suntou-gun (JP); Atsushi Okuda, Yokohama (JP); Takeshi Murakami, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/498,158

(22) Filed: Sep. 26, 2014

(65) Prior Publication Data

US 2015/0093695 A1 Apr. 2, 2015

(30) Foreign Application Priority Data

Sep. 30, 2013 (JP) ..... 2013-205135
Aug. 26, 2014 (JP) ..... 2014-171782

(51) Int. Cl.
*G03G 5/14* (2006.01)
*G03G 5/06* (2006.01)
*G03G 5/10* (2006.01)

(52) U.S. Cl.
CPC ..... *G03G 5/0605* (2013.01); *G03G 5/0614* (2013.01); *G03G 5/0616* (2013.01); *G03G 5/0675* (2013.01); *G03G 5/0696* (2013.01); *G03G 5/105* (2013.01); *G03G 5/144* (2013.01)

(58) Field of Classification Search
CPC ..... G03G 5/142; G03G 5/144
See application file for complete search history.

(56) References Cited

U.S. PATENT DOCUMENTS 4,442,193 A 4/1984 Chen
4,562,132 A 12/1985 Ong
4,992,349 A 2/1991 Chen
5,468,583 A 11/1995 Gruenbaum
2008/0124126 A1* 5/2008 Anezaki ..... G03G 5/00 399/159

(Continued)

FOREIGN PATENT DOCUMENTS

JP 1-206349 A 8/1989
JP 5-279582 A 10/1993

(Continued)

OTHER PUBLICATIONS

Brooks A. Jones et al.; "Chemistry of Materials"; American Chemical Society; vol. 19, No. 11, pp. 2703-2705 (2007).

(Continued)

*Primary Examiner* — Hoa V Le
(74) *Attorney, Agent, or Firm* — Canon USA, Inc. IP Division

(57) ABSTRACT

An electrophotographic photosensitive member includes a laminated body including a conductive support, a first intermediate layer on the conductive support, and a second intermediate layer on the first intermediate layer, the first intermediate layer containing a binder resin and a metal oxide particle whose surface have been treated with an organic compound, and the second intermediate layer containing a cured product having electron transportability, in which the laminated body satisfies the following expression (1):

$$R_nV/R_0V \leq 0.80 \quad (1).$$

15 Claims, 5 Drawing Sheets

(56) References Cited

U.S. PATENT DOCUMENTS

| | | | | |
|---|---|---|---|---|
| 2012/0301181 | A1* | 11/2012 | Ogaki | G03G 5/0564 399/111 |
| 2013/0137023 | A1* | 5/2013 | Watariguchi | G03G 5/142 430/56 |
| 2014/0004451 | A1* | 1/2014 | Tomono | G03G 15/00 430/56 |
| 2014/0004455 | A1* | 1/2014 | Sekido | G03G 15/00 430/56 |
| 2014/0011127 | A1* | 1/2014 | Nakamura | G03G 5/0575 430/56 |

FOREIGN PATENT DOCUMENTS

| | | | |
|---|---|---|---|
| JP | 7-70038 | A | 3/1995 |
| JP | 9-151157 | A | 6/1997 |
| JP | 2005-189764 | A | 7/2005 |
| JP | 3717320 | B2 | 11/2005 |
| JP | 2007-108670 | A | 4/2007 |
| JP | 2007-148294 | A | 6/2007 |
| JP | 2008-065173 | A | 3/2008 |
| JP | 2008-250082 | A | 10/2008 |
| JP | 2009-505156 | A | 2/2009 |

OTHER PUBLICATIONS

Ronald Callahan et al. ; "Syntheses of Phencyclone Analogues. Applications for NMR Studies of Hindered Rotations and Magnetic Anisotropy in Crowded Diels-Alder Adducts;" Chem. Educator; No. 6, pp. 227-234 (2001).

Shimpachiro Kato et al.; "Nitration of Phenanthrenequinone;" Journal of Synthetic Organic Chemistry; Japan, vol. 15, pp. 32-34 (1957).

Hiroyuki Miyamura et al.; "Polymer Incarcerated Gold Catalyzed Aerobic Oxidation of Hydroquinones and Their Derivatives;" Chemistry Letters; vol. 37, No. 3, pp. 360-361 (2008).

Hideki Okada et al., "Synthesis and Properties of a Novel Electron Transporting Compound, 3,3'-Dialky-4,4'-Bisnaphthylquinone (DBNQ);" PPCI/Japan Hardcopy '98, p. 207-210 (1998).

Brooks A. Jones et al.; "Tuning Orbital Energetics in Arylene Diimide Semiconductors. Materials Design for Ambient Stability of n-type Charge Transport;" Journal of the American Chemical Society; vol. 129, No. 49, pp. 15259-15278 (2007).

Takahiro Fujiyama et al.; "Development of New Electron Transport Material With High Drift Mobility;" J. Imaging Soc. Japan 2006, 45(6), pp. 521-525.

Kakyouzai Handbook (Crosslinking Agent), edited by Shinzo Yamashita and Tosuke Kaneko, published by Taiseisya Ltd. (1981).

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, and a process cartridge and an electrophotographic apparatus each including an electrophotographic photosensitive member.

2. Description of the Related Art

Currently, electrophotographic photosensitive members containing organic photoconductive materials are mainly used as electrophotographic photosensitive members for use in process cartridges and electrophotographic apparatuses. Typically, an electrophotographic photosensitive member includes a support and a photosensitive layer disposed on the support. To inhibit the charge injection from the support side to the photosensitive layer side (charge generating layer) and inhibit the occurrence of image failure, such as fogging, an intermediate layer is provided between the support and the photosensitive layer. To cover a surface defect of the support, it is known that a conductive layer containing metal oxide particles may be provided.

In recent years, charge generating materials with higher sensitivities have been used. A higher sensitivity of a charge generating material results in a larger amount of charges generated. Thus, charges in exposed portions are disadvantageously liable to stay in photosensitive layers when a very large number of the same images are output in a short period of time. As a technique for inhibiting the residence of charges in a photosensitive layer, it is known that a technique in which the incorporation of an electron transporting material into an intermediate layer permits the intermediate layer to have an ability to transport electrons (hereinafter, also referred to as an "electron transporting layer").

PCT Japanese Translation Patent Publication No. 2009-505156 discloses an electrophotographic photosensitive member including an electron transporting layer that contains a polymer of a crosslinking agent and a condensation polymer (electron transporting material) having a crosslinking site, and an aromatic tetracarbonylbisimide skeleton; and a conductive layer that contains tin oxide particles. Japanese Patent Laid-Open No. 2008-65173 discloses an electrophotographic photosensitive member including a layer that contains an electron acceptor material; and a conductive layer that contains an electron acceptor material and zinc oxide particles whose surfaces are treated with a silane coupling agent.

Japanese Patent Laid-Open Nos. 2007-148294 and 2008-250082 disclose electrophotographic photosensitive members including electron transporting layers on conductive layers that contain titanium oxide particles coated with tin oxide.

In recent years, electrophotographic images have been required to have better image quality. The number of opportunities to output a very large number of the same images in a short period of time has been increased.

The results of studies by the inventors demonstrated that in that case, image failure what is called pattern memory is liable to occur. The term "pattern memory" refers to a phenomenon in which when a solid black image 302 is output after a large number of images 301 each containing vertical lines 306 in FIG. 3 are continuously output, the output solid black image is an image 304 containing vertical lines 307 due to the repetitive hysteresis of the vertical lines 306 in the images 301 illustrated in FIG. 3. When a halftone image 303 is output after a large number of the images 301 are continuously output, the term "pattern memory" refers to a phenomenon in which the halftone image is an image 305 containing vertical lines 308 due to the repetitive hysteresis of the vertical lines 306 in the images 301 illustrated in FIG. 3, as with the solid black image.

It was found than in the electrophotographic photosensitive members including the conductive layers and the electron transporting layer or the electron acceptor material-containing layer described in PCT Japanese Translation Patent Publication No. 2009-505156 and Japanese Patent Laid-Open No. 2008-65173, charges are liable to stay between each of the conductive layers and a corresponding one of the electron transporting layers, so that the foregoing pattern memory occurs, in some cases.

To inhibit the retention of charges between the conductive layer and the electron transporting layer, it is conceivable that the electrical resistance is reduced by increasing the content of metal oxide particles in the conductive layer. However, it was found that the reduction in the electrical resistance of the conductive layer leads to insufficient adhesion of the electron transporting layer and thus that the application of a high voltage is liable to cause leakage to occur in the electrophotographic photosensitive member. The term "leakage" refers to a phenomenon in which dielectric breakdown occurs in a local portion of an electrophotographic photosensitive member, and excessive current flows therethrough. The occurrence of the leakage can cause image failure, for example, a black spot or a horizontal black line, because the electrophotographic photosensitive member is not sufficiently charged.

SUMMARY OF THE INVENTION

According to one aspect of the invention, an electrophotographic photosensitive member includes:

a laminated body, a charge generating layer on the laminated body, and a hole transporting layer on the charge generating layer, in which the laminated body includes:

a conductive support, a first intermediate layer on the conductive support, and containing a binder resin and a metal oxide particle whose surface have been treated with an organic compound, and a second intermediate layer on the first intermediate layer, and containing a cured product having electron transportability, in which the laminated body satisfies the following expression (1):

$$R_nV/R_0V \leq 0.80 \quad (1)$$

where R_nV represents impedance of the laminated body measured by the steps of:

forming, on a surface of the second intermediate layer, a circular-shaped gold electrode having a thickness of approximately 300 nm and a diameter of approximately 12 mm by sputtering, and applying, between the conductive support and the circular-shaped gold electrode, an alternating electric field having a voltage of approximately $3.0\times10^{-3}$ V/μm and a frequency of approximately 0.1 Hz while applying, from the conductive support to the circular-shaped gold electrode, a direct electric field having a voltage approximately −0.3 V/μm, and measuring the impedance, and, R_0V represents impedance of the laminated body measured by the steps of:

forming, on a surface of the second intermediate layer, a circular-shaped gold electrode having a thickness of approximately 300 nm and a diameter of approximately 12 mm by sputtering, applying, between the conductive support and the circular-shaped gold electrode, an alternating electric field having a voltage of approximately $3.0\times10^{-3}$ V/μm and a frequency of approximately 0.1 Hz while applying, from the conductive support to the circular-shaped gold electrode, a direct electric field having a voltage 0 V/μm.

According to another aspect of the invention, a process cartridge detachably attachable to a main body of an electrophotographic apparatus integrally supports the electrophotographic photosensitive member and at least one device selected from the group consisting of a charging device, a developing device, and a cleaning device.

According to another aspect of the invention, an electrophotographic apparatus includes the electrophotographic photosensitive member, a charging device, an exposure device, a developing device, and a transfer device.

Further features of the present invention will become apparent from the following description of exemplary embodiments with reference to the attached drawings.

DESCRIPTION OF THE EMBODIMENTS

Figure 1:
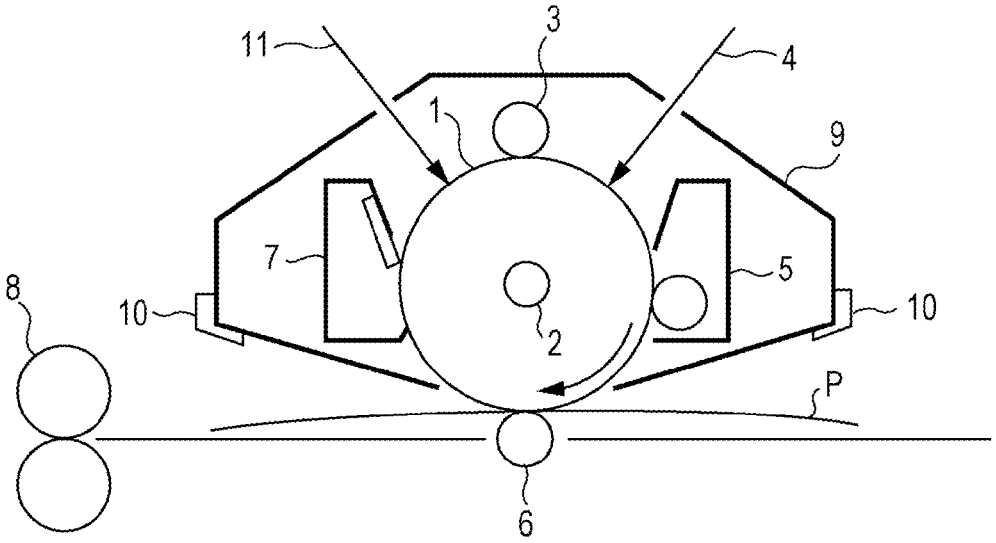
FIG. 1 illustrates a schematic structure of an electrophotographic apparatus including a process cartridge provided with an electrophotographic photosensitive member.

An electrophotographic photosensitive member according to an embodiment the present invention includes a laminated body, a charge generating layer on the laminated body, and a hole transporting layer on the charge generating layer. The laminated body includes a first intermediate layer on a conductive support, and a second intermediate layer on the first intermediate layer.

In the electrophotographic photosensitive member according to an embodiment of the present invention, the laminated body satisfies the following expression (1):

$$R_nV/R_0V\leq0.80 \quad (1)$$

where R_nV and R__0V each represent impedance measured as described below.

All numerical values are approximate as known by one skilled in the arts.

A circular-shaped gold electrode having a thickness of 300 nm and a diameter of 12 mm is formed by sputtering on a surface of the second intermediate layer of the laminated body. The impedance is measured by applying an alternating electric field having a voltage of $3.0\times10^{-3}$ V/μm and a frequency of 0.1 Hz between the conductive support and the gold electrode while a direct electric field having a voltage of −0.3 V/μm is applied from the conductive support to the gold electrode. The term "a direct electric field having a voltage of −0.3 V/μm" indicates that a direct electric field of −0.3 V is applied to the unit thickness (μm) of the total thickness of the first intermediate layer and the second intermediate layer. The term "an alternating electric field having a voltage of $3.0\times10^{-3}$ V/μm" indicates that an alternating electric field having a voltage of $3.0\times10^{-3}$ V is applied to the unit thickness (μm) of the total thickness of the first intermediate layer and the second intermediate layer. The peak-to-peak value of a sinusoidal wave of an alternating electric field having a voltage of $3.0\times10^{-3}$ V/μm is $6.0\times10^{-3}$ V/μm.

R__0V represents impedance measured as described below. The gold electrode is formed by sputtering on a surface of the second intermediate layer of the laminated body. The impedance is measured by applying an alternating electric field having a voltage of $3.0\times10^{-3}$ V/μm and a frequency of 0.1 Hz between the conductive support and the gold electrode while a direct electric field having a voltage of 0 V is applied from the conductive support to the gold electrode.

A determination method that makes the determination as to whether the electrophotographic photosensitive member satisfies the relationship represented by the expression (1) or not (hereinafter, referred to as a "determination method according to an embodiment of the present invention") will be described below. With respect to temperature and humidity conditions under which the determination method according to an embodiment of the present invention is performed, an environment in which the electrophotographic apparatus including the electrophotographic photosensitive member is used may be used. A normal-temperature, normal-relative-humidity environment (temperature: 23° C.±3° C., humidity: 50%±5% RH) may be used.

This measurement method is performed with the laminated body. At that time, the hole transporting layer and the charge generating layer may be removed from the electrophotographic photosensitive member including the laminated body, the charge generating layer on the laminated body, and the hole transporting layer on the charge generating layer to provide the laminated body, and the resulting laminated body may be used as a measurement object. As a method for removing the hole transporting layer and the charge generating layer, there are two methods. One of the methods is a method for removing the hole transporting layer and the charge generating layer by dissolving the hole transporting layer and the charge generating layer and immersing the electrophotographic photosensitive member in a solvent in which the second intermediate layer is substantially insoluble. The other method is a method in which the hole transporting layer and the charge generating layer are ground.

The solvent in which the hole transporting layer and the charge generating layer are dissolved and in which the second intermediate layer is substantially insoluble may be a solvent used for a hole transporting layer coating liquid or charge generating layer coating liquid. The type of the solvent is described below. It is possible to provide the laminated body by immersing the electrophotographic photosensitive member in the solvent, dissolving the hole transporting layer and the charge generating layer in the solvent, and performing drying. The removal of the hole transporting layer and the charge generating layer may be confirmed by the fact that resin components in the hole transporting layer and the charge generating layer are not observed by, for example, attenuated total reflectance (ATR) spectroscopy in Fourier transform infrared (FT-IR) spectroscopy.

An example of a method for grinding the hole transporting layer and the charge generating layer is a method in which grinding is performed with, for example, a lapping tape (C2000, manufactured by Fuji Photo Film Co., Ltd.) while the pressing pressure is controlled to 0.005 N/m2 or more and 15 N/m2 or less. At that time, the thickness may be appropriately measured so as not to excessively grind the charge generating layer to grind the second intermediate layer, and the hole transporting layer and the charge generating layer may be completely removed while the surface of the electrophotographic photosensitive member is observed. It has been confirmed that in the case where the charge generating layer is ground and then the second intermediate layer is ground so as to have a thickness of 0.10 μm or more, substantially the same value as that in the case where the second intermediate layer is not ground is obtained by the foregoing determination method. Thus, in the case where the second intermediate layer is also ground in addition to the hole transporting layer and the charge generating layer, the foregoing determination method may be employed as long as the second intermediate layer has a thickness of 0.10 μm or more.

Figure 2:
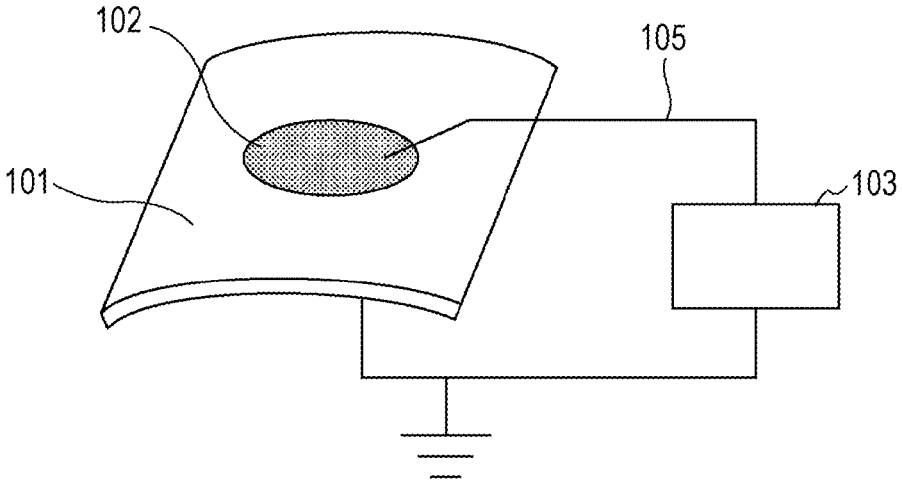
FIG. 2 illustrates an example of a schematic structure of a determination apparatus used to perform a determination method according to an embodiment of the present invention.
Figure 3:
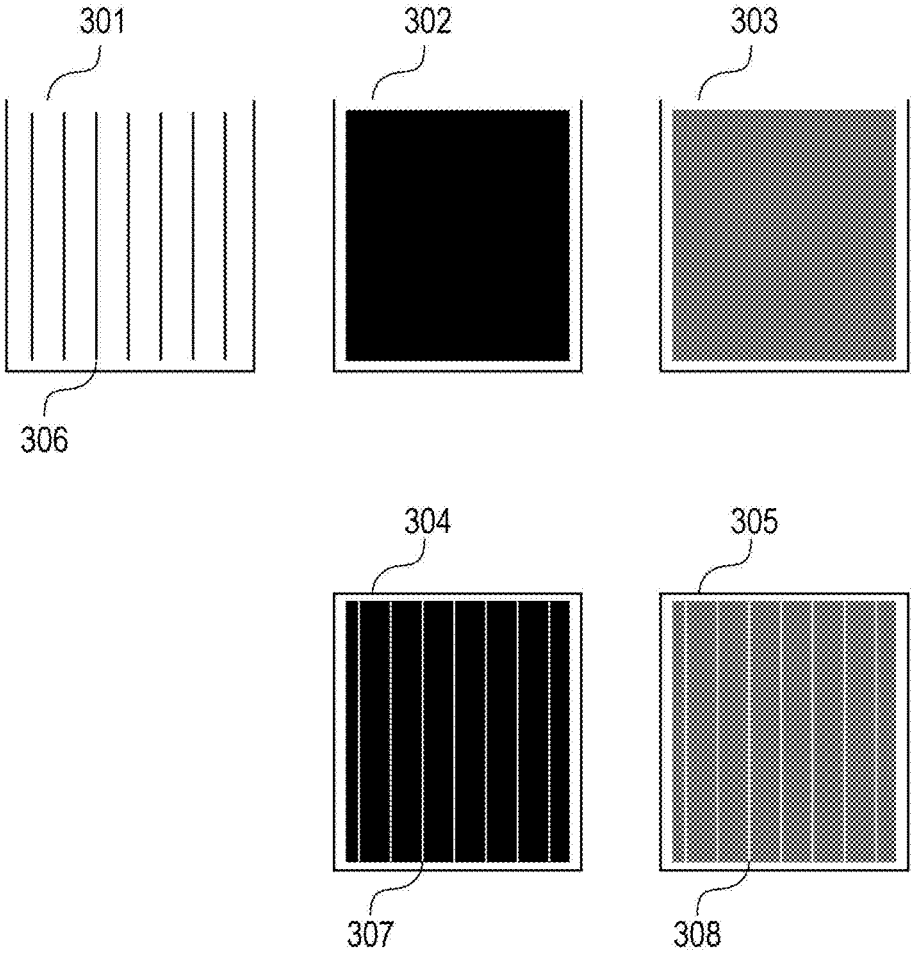
FIG. 3 illustrates pattern memory.

FIG. 2 illustrates an example of a schematic structure of a determination apparatus used to perform a determination method according to an embodiment of the present invention. In FIG. 2, a laminated body 101 that has been cut out so as to have a size of 2 cm (in the circumferential direction)×4 cm (in the longitudinal direction) is a measurement object. A circular-shaped gold electrode 102 having a diameter of 12 mm and a thickness of 300 nm is deposited by sputtering on a surface of the second intermediate layer of the laminated body. In a method for depositing gold, a coater (Model: Quick Auto Coater SC-707AT, manufactured by Sanyu Electron Co., Ltd.) may be used. A gold target is arranged above the surface of the second intermediate layer. The deposition is performed with the discharge current maintained at 20 mA until the thickness reaches 300 nm, thereby forming the gold electrode. Lead wires 105 are connected to the gold electrode on the second intermediate layer and the conductive support. An impedance measuring instrument 103 is connected to the lead wires 105. An example of the impedance measuring instrument that may be used is a measurement module in which SI 1287 electrochemical interface, SI 1260 impedance/gain-phase analyzer, and 1296 dielectric interface, which are available from TOYO Corporation, are combined together.

According to an embodiment of the present invention, the impedance is measured with the entire system illustrated in FIG. 2 shielded from room light. Regarding R_0V in the expression, a direct electric field having a voltage of 0 V is applied from the conductive support to the gold electrode by setting "DC Level" to 0 V. Furthermore, an alternating electric field having a voltage of $3.0\times10^{-3}$ V/μm is applied between the conductive support and the gold electrode by setting "AC Level" to a value such that the alternating electric field has a voltage of $3.0\times10^{-3}$ V/μm with respect to the total thickness of the first intermediate layer and the second intermediate layer. Next, the frequency of the alternating electric field is swept from a high-frequency of 1 MHz to a low frequency of 0.1 Hz to measure impedance, resulting in impedance (R_0V) at 0.1 Hz. That is, R_0V indicates impedance measured by applying an alternating electric field having a voltage of $3.0\times10^{-3}$ V/μm and a frequency of 0.1 Hz between the conductive support and the gold electrode while a direct electric field having a voltage of 0 V is applied from the conductive support to the gold electrode.

Regarding R_nV, a direct electric field having a voltage of −0.3 V/μm is applied from the conductive support to the gold electrode by setting "DC Level" to a value such that the direct electric field has a voltage of −0.3 V/μm with respect to the total thickness of the first intermediate layer and the second intermediate layer. An alternating electric field having a voltage of $3.0\times10^{-3}$ V/μm is applied between the conductive support and the gold electrode by setting "AC Level" to a value such that the alternating electric field has a voltage of $3.0\times10^{-3}$ V/μm with respect to the total thickness of the first intermediate layer and the second intermediate layer. Next, the frequency of the alternating electric field is swept from a high-frequency of 1 MHz to a low frequency of 0.1 Hz to measure impedance, resulting in impedance (R_nV) at 0.1 Hz. That is, R_nV indicates impedance measured by applying an alternating electric field having a voltage of $3.0\times10^{-3}$ V/μm and a frequency of 0.1 Hz between the conductive support and the gold electrode while a direct electric field having a voltage of −0.3 V/μm is applied from the conductive support to the gold electrode.

Figure 7:
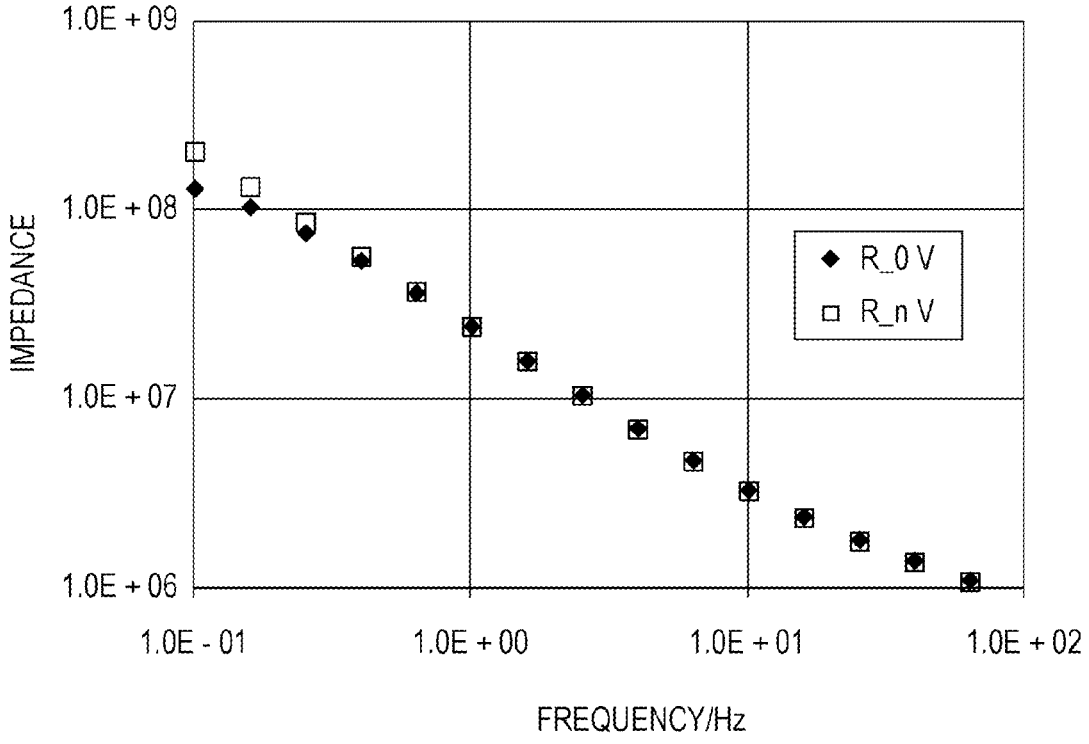
FIG. 7 is a graph illustrating typical examples of R_nV and R__0V when the determination method according to an embodiment of the present invention is performed.

FIG. 7 illustrates typical examples of R_nV and R_0V. The vertical axis and the horizontal axis are logarithmically graduated. FIG. 7 illustrates the dependence of the impedance (R_nV and R_0V) measured by the foregoing methods on frequency. In particular, a larger difference in impedance is observed at lower frequencies because of a difference in the magnitude of the direct electric field applied. That is, the ratio of R_nV to R_0V, i.e., R_nV/R_0V, is 0.80 or lower at 0.1 Hz.

In an embodiment of the present invention, in order to inhibit the occurrence of the pattern memory, the ratio of R_nV to R_0V, i.e., R_nV/R_0V, is 0.80 or less. The inventors speculate the reason the occurrence of the pattern memory is inhibited by the fact that the laminated body according to an embodiment of the present invention satisfies the foregoing expression (1), as described below.

The occurrence of the pattern memory is seemingly inhibited by the extensive formation of satisfactory conductive paths between the first intermediate layer and the second intermediate layer. In other words, the occurrence of the pattern memory is seemingly inhibited by uniformly injecting charges (electrons) stayed in the second intermediate layer into the first intermediate layer. The reason for this is presumably that the local retention or accumulation of charges in the first intermediate layer is inhibited to provide a smooth flow of charges.

For the electrophotographic photosensitive member according to an embodiment of the present invention, in a portion on which exposure light (image exposure light) is incident, among charges (holes and electrons) generated in the charge generating layer, holes are injected into the hole transporting layer, and electrons are injected into the second intermediate layer and the first intermediate layer and then transferred to the conductive support. However, in the case where some electrons generated in the charge generating layer due to optical excitation are not transferred from the second intermediate layer and the first intermediate layer before next charging, electrons stay in the first intermediate layer and the second intermediate layer, thus causing electron transfer during the next charging. These phenomena are liable to occur at the time of the repeated use of the electrophotographic photosensitive member. The number of electrons that stay at the interface between the first intermediate layer and the second intermediate layer is readily increased. The increase in the number of electrons is seemingly due to the barrier of a conduction level between the first intermediate layer and the second intermediate layer or the trapping of electrons in a trap level. The inventors believe that slowly migrating electrons generated by the retention of electrons at the interface between the first intermediate layer and the second intermediate layer causes the foregoing pattern memory.

To inhibit the retention of electrons, the first intermediate layer contains a binder resin and metal oxide particles whose surfaces have been treated with an organic compound, and the second intermediate layer contains a cured product having electron transportability (electron transporting cured product). In this structure, the retention of electrons is seemingly reduced by conductivity owing to the metal oxide particles in the first intermediate layer and the cured product having electron transportability in the second intermediate layer. In the electrophotographic photosensitive member including the first intermediate layer and the second intermediate layer, however, the occurrence of the pattern memory is not sufficiently inhibited, in some cases.

In the case where the laminated body satisfies the expression (1), electron transport is seemingly promoted at the interface between the second intermediate layer and the first intermediate layer. In an embodiment of the present invention, when the impedance is measured with the electrophotographic photosensitive member including the charge generating layer and the hole transporting layer, the electron transfer at the interface between the second intermediate layer and the first intermediate layer is less likely to be correctly reflected. The determination method according to an embodiment of the present invention with the laminated body is to be performed. However, the laminated body does not include a charge generating layer; hence, no electron is generated by optical excitation in the charge generating layer. Thus, as described in the determination method according to an embodiment of the present invention, the inventors believe that the application of a direct electric field having a voltage of −0.3 V/μm to the laminated body serves as pseudo-optical excitation that contributes to the generation of electrons in the charge generating layer. In other words, the inventors believe that the application of a specific direct electric field between the first intermediate layer and the second intermediate layer results in the release of electrons accumulated at the trap level of the second intermediate layer, and the released electrons are transferred from the conduction level of the second intermediate layer to the conduction level of the first intermediate layer.

In the determination method according to an embodiment of the present invention, in the case where the impedance value obtained by applying a direct electric field having a voltage of −0.3 V/μm is equal to that obtained by applying a direct electric field having a voltage of 0 V, the injection of electrons from the second intermediate layer to the first intermediate layer is insufficient. In this case, electrons tend to stay, and the number of slowly migrating electrons tends to increase. The tendency is seemingly observed when the value of R_nV/R_0V is more than 0.80. In contrast, in the case where the impedance value obtained by applying a direct electric field having a voltage of −0.3 V/μm is lower than that obtained by applying a direct electric field having a voltage of 0 V, it is believed that electrons are sufficiently injected from the second intermediate layer to the first intermediate layer. This will inhibit an increase in the number of slowly migrating electrons in the second intermediate layer to reduce the retention of electrons.

The degree of the increase in the number of the slowly migrating electrons may be determined by focusing attention on the impedance at a low frequency. In the determination method according to an embodiment of the present invention, the inventors focus attention on a frequency of 0.1 Hz as the low frequency. It is believed that any frequency equal to or lower than 0.1 Hz may be used to express the impedance of the slowly migrating electrons. In an embodiment of the present invention, the impedance at a frequency of 0.1 Hz is regarded as the impedance of the slowly migrating electrons. A frequency of 0.1 Hz has a period of about 10 seconds and is believed to provide a state in which the pattern memory occurs readily because electrons that respond to the electric field at a period of about 10 seconds stay at the interface between the second intermediate layer and the first intermediate layer through the repeated use of the electrophotographic photosensitive member.

A state that satisfies the expression (1) is a state which provides good injection properties and in which an increase in the number of slowly migrating electrons is inhibited. It will be possible to inhibit the retention of electrons and reduce the occurrence of the pattern memory during the repeated use of the electrophotographic photosensitive member.

Japanese Patent Laid-Open No. 2005-189764 discloses that an undercoat layer (second intermediate layer) has a charge mobility of $10^{-7}$ cm2/V·sec or more. However, an electrophotographic photosensitive member described in Japanese Patent Laid-Open No. 2005-189764 seems to be intended to increase the mobility of electrons and does not seem to be intended to inhibit an increase in the number of slowly migrating electrons. In Japanese Patent Laid-Open No. 2005-189764, in order to measure the electron mobility in the second intermediate layer, an inverted structure of a layer structure used in the electrophotographic photosensitive member, i.e., a structure in which the second intermediate layer is formed on a charge generating layer, is used for the measurement. In this measurement, however, the transfer of electrons in the second intermediate layer included in the electrophotographic photosensitive member is not sufficiently evaluated.

For example, in the case where an electron transporting material is incorporated into the second intermediate layer to form an electron transporting layer, when a charge generating layer coating liquid and a hole transporting layer coating liquid are applied to form a charge generating layer and a hole transporting layer, respectively, serving as upper layers of the electron transporting layer, the electron transporting material can be eluted. In this case, even if the electron mobility is measured with the structure in which the second intermediate layer and the charge generating layer are inverted as described above, the transfer of electrons in the second intermediate layer is not correctly evaluated because of the elution of the electron transporting material. The determination method according to an embodiment of the present invention with the laminated body having a layer structure according to an embodiment of the present invention is to be performed.

In an embodiment of the present invention, the value of R_nV/R_0V may satisfy the following expression (2) because the occurrence of the pattern memory is further inhibited. A lower value of R_nV/R_0V provides the effect of further inhibiting the pattern memory. Thus, the value of R_nV/R_0V may be more than zero.

$$0.40 \leq R_nV/R_0V \leq 0.75 \quad (2)$$

The electrophotographic photosensitive member according to an embodiment of the present invention includes the laminated body, the charge generating layer on the laminated body, and the hole transporting layer on the charge generating layer. The laminated body includes the conductive support, the first intermediate layer on the conductive support, and the second intermediate layer on the first intermediate layer.

Figure 6:
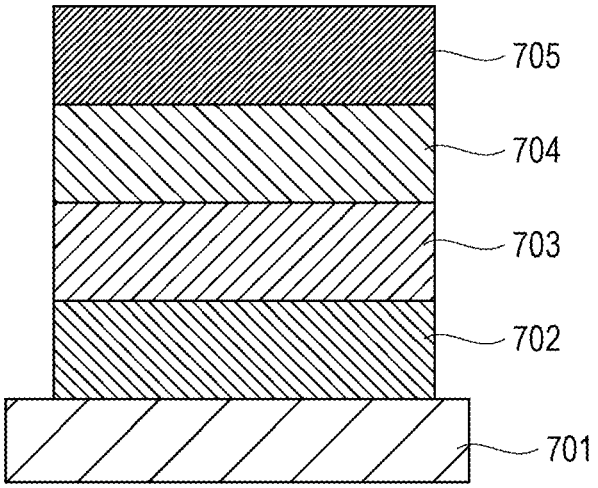
FIG. 6 illustrates an example of a layer structure of an electrophotographic photosensitive member.

FIG. 6 illustrates an example of a layer structure of an electrophotographic photosensitive member. In FIG. 6, the electrophotographic photosensitive member includes a conductive support 701, a first intermediate layer 702, a second intermediate layer 703, a charge generating layer 704, and a hole transporting layer 705.

Electrophotographic photosensitive members, each including photosensitive layers (a charge generating layer and a hole transporting layer) on a cylindrical conductive support, are widely used as typical electrophotographic photosensitive members. Electrophotographic photosensitive members may have belt- and sheet-like shapes.

First Intermediate Layer

The first intermediate layer contains a binder resin and metal oxide particles whose surfaces have been treated with an organic compound.

Examples of the binder resin include phenolic resins, polyurethane resins, polyamide resins, polyimide resins, polyamide-imide resins, polyvinyl acetal resins, epoxy resins, acrylic resins, melamine resins, and polyester resins. These resins may be used separately or in combination. Of these binder resins, in view of resistance to a solvent in a coating liquid used to form another layer, adhesiveness to the conductive support, and the dispersibility and dispersion stability of the metal oxide particles, a curable resin may be used. In particular, a thermosetting resin may be used. Examples of the thermosetting resin include thermosetting phenolic resins and thermosetting polyurethane resins. In the case where a thermosetting resin is used as the binder resin for the first intermediate layer, a first intermediate layer coating liquid contains monomers and/or oligomers to be formed into the thermosetting resin.

The organic compound used to surface-treat the metal oxide particles is not particularly limited and is selected from organic compounds used as known surface treatment agents. Examples thereof include silane coupling agents, titanate coupling agents, aluminum coupling agents, and surfactants. In particular, an organic compound having an alkoxysilyl group, an amino group, an epoxy group, a carboxy group, a hydroxy group, or a thiol group is exemplified. A silane coupling agent may be used in view of electrophotographic properties.

The organic compound may have a molecular weight of 100 to 1000. Within the range, it is possible to improve the effect of inhibiting leakage and further reduce the accumulation of residual charges.

Examples of a compound having an alkoxysilyl group include γ-aminopropyltriethoxysilane, N-β-(aminoethyl)-γ-aminopropyltrimethoxysilane, N-β-(aminoethyl)-γ-aminopropylmethyldimethoxysilane, and N,N-bis(β-hydroxyethyl)-γ-aminopropyltriethoxysilane.

Examples of a compound having an amino group include hexylamine, n-octylamine, n-decylamine, 1-aminododecane, 1-tetradecylamine, and 1-hexadecylamine.

Examples of a compound having an epoxy group include 1,2-epoxyhexane, 1,2-epoxyheptane, 1,2-epoxyoctane, 1,2-epoxynonane, 1,2-epoxydecane, 1,2-epoxyundecane, 1,2-epoxydodecane, 1,2-epoxytridecane, 1,2-epoxytetradecane, and 1,2-epoxypentadecane.

Examples of a compound having a carboxy group include heptanoic acid, octanoic acid, nonanoic acid, decanoic acid, undecanoic acid, dodecanoic acid, tridecanoic acid, tetradecanoic acid, pentadecanoic acid, and hexadecanoic acid.

Examples of a compound having a hydroxy group include 1-hexanol, 1-heptanol, 1-octanol, 1-nonanol, 1-decanol, 1-undecanol, 1-dodecanol, 1-tridecanol, 1-tetradecanol, and 1-pentadecanol.

Examples of a compound having a thiol group include 1-hexanethiol, 1-heptanethiol, 1-octanethiol, 1-nonanethiol, 1-decanethiol, 1-undecanethiol, 1-dodecanethiol, 1-tridecanethiol, 1-tetradecanethiol, and 1-pentadecanethiol.

It is believed that the surface treatment of the metal oxide particle with the organic compound permits the dispersed state of the metal oxide particles in the first intermediate layer to be stably maintained and enables conductive paths to be uniformly formed in the first intermediate layer. This presumably inhibits the concentration of a current on a local conductive path and inhibits leakage.

Examples of a surface treatment process for surface-treating the metal oxide particles includes known processes, such as dry processes and wet processes.

In the case where the metal oxide particles are subjected to surface treatment by a dry process, the surface treatment is performed by adding or spraying an organic compound or a solution of an organic compound in an organic solvent on the metal oxide particles together with dry air or nitrogen gas while the metal oxide particles are stirred with a high-shear mixer. The addition or spraying may be performed at a temperature equal to or lower than the boiling point of the organic solvent. After the addition or spraying, baking may be performed at 100° C. or higher. The temperature and time of the baking may be freely selected.

In the case of a wet process, the surface treatment is performed as follows: The metal oxide particles are dispersed in a solvent by stirring or with ultrasonic waves, a sand mill, an attritor, or a ball mill. An organic compound is added thereto. After the mixture is stirred or dispersed, the organic solvent is removed. As a method for removing the organic solvent, a filtration method or an evaporation method by distillation may be employed. After the removal of the organic solvent, baking may be performed at 100° C. or higher. The temperature and time of the baking are not particularly limited as long as electrophotographic properties are obtained.

The amount of the organic compound added when the metal oxide particles to be contained in the first intermediate layer are subjected to surface treatment may be 0.5% by mass or more and 20% by mass or less with respect to the metal oxide particles.

Examples of the metal oxide particles include particles composed of zinc oxide, white lead, aluminum oxide, indium oxide, silicon oxide, zirconium oxide, tin oxide, titanium oxide, magnesium oxide, antimony oxide, bismuth oxide, tin-doped indium oxide, and tin oxide doped with antimony or tantalum. Of these, particles of zinc oxide, tin oxide, and titanium oxide may be used. In particular, titanium oxide particles do not substantially absorb visible light or near-infrared light and is white. Thus, titanium oxide particles may be used from the viewpoint of achieving higher sensitivity. Alternatively, two or more types of metal oxide particles may be selected from the foregoing metal oxide particles and may be used in combination.

Examples of the crystal form of titanium oxide include rutile, anatase, brookite, and amorphous types. Any of the crystal forms may be used. Moreover, titanium oxide particles in the form of needle or granular crystals may be used. In particular, rutile-type titanium oxide crystal particles may be used.

The metal oxide particles may have, on a number basis, an average primary particle diameter of 0.05 to 1 μm and more, may have an average primary particle diameter of approximately 0.1 to 0.5 μm from the viewpoint of inhibiting leakage and the occurrence of the pattern memory.

The first intermediate layer may be formed by applying the first intermediate layer coating liquid containing a solvent, the binder resin, and the metal oxide particle whose surface have been treated with the organic compound to the conductive support to form a coating film and drying and/or curing the resulting coating film.

The first intermediate layer coating liquid may be prepared by dispersing the binder resin and the metal oxide particles in the solvent, the metal oxide particles having subjected to surface treatment with the organic compound. Examples of a dispersion method include methods with paint shakers, sand mills, ball mills, and liquid-collision type high-speed dispersers.

Examples of the solvent used for the first intermediate layer coating liquid include alcohols, such as methanol, ethanol, and isopropanol; ketones, such as acetone, methyl ethyl ketone, and cyclohexane; ethers, such as tetrahydrofuran, dioxane, ethylene glycol monomethyl ether, and propylene glycol monomethyl ether; esters, such as methyl acetate and ethyl acetate; and aromatic hydrocarbons, such as toluene and xylene.

To suppress the occurrence of interference fringes, the first intermediate layer may contain a surface roughening material. As the surface roughening material, resin particles having a number-average particle diameter of 1 μm or more and 5 μm or less may be used. Examples of the resin particles include particles composed of curable rubber, polyurethane, epoxy resins, alkyd resins, phenolic resins, polyester, silicone resins, and acrylic-melamine resins. The first intermediate layer may contain a leveling agent and pigment particles.

The first intermediate layer may have a thickness of approximately 2 μm or more and approximately 40 μm or less, i.e., approximately 10 μm or more and 30 μm or less.

As a measuring instrument for measuring the layers of the electrophotographic photosensitive member including the first intermediate layer, FISHERSCOPE mms manufactured by Fischer Instruments K.K. was used.

The first intermediate layer may have a volume resistivity of $1.0\times10^{8}$ Ω·cm or more. Moreover, the first intermediate layer may have a volume resistivity of $1.0\times10^{15}$ Ω·cm or less. Within the range, an excessively large amount of charges does not pass through the first intermediate layer during charging and exposure of the electrophotographic photosensitive member, so that leakage in the electrophotographic photosensitive member is less likely to occur. In particular, the first intermediate layer may have a volume resistivity of $3.7\times10^{11}$ Ω·cm or more and $3.1\times10^{14}$ Ω·cm or less.

Figure 4A:
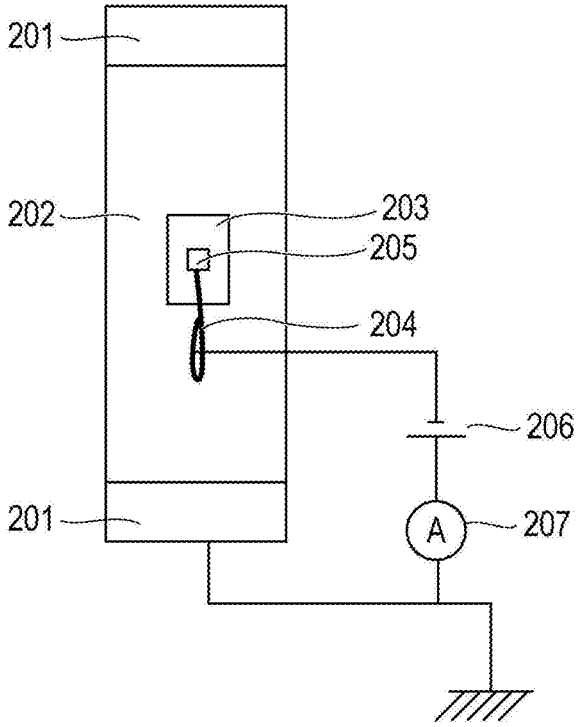
FIG. 4A is a top view illustrating a method for measuring the volume resistivity of a first intermediate layer.
Figure 4B:
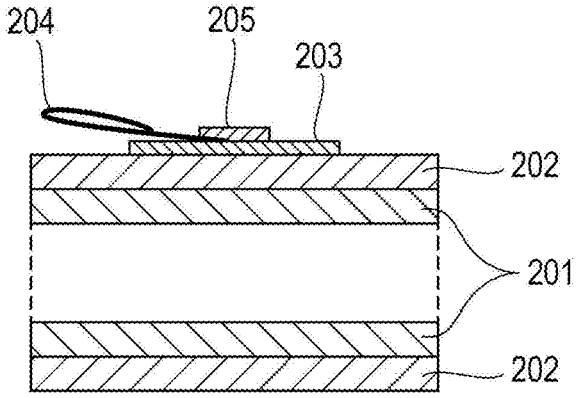
FIG. 4B is a cross-sectional view of the first intermediate layer illustrated in FIG. 4A.
Figure 5:
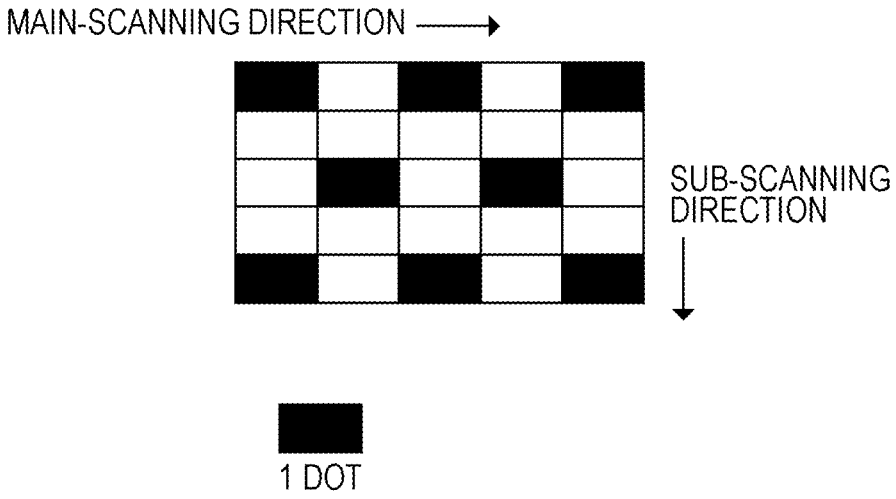
FIG. 5 illustrates a one-dot, Keima pattern image (similar to a knight-jump pattern).

A method for measuring the volume resistivity of the first intermediate layer will be described below. FIG. 4A is a top view illustrating a method for measuring the volume resistivity of the first intermediate layer. FIG. 4B is a cross-sectional view illustrating the method for measuring the volume resistivity of the first intermediate layer.

The volume resistivity of the first intermediate layer is measured in a normal-temperature, normal-relative-humidity environment (temperature: 23° C.±3° C., humidity: 50%±5% RH). A copper tape 203 (Model 1181, manufactured by Sumitomo 3M Limited) is bonded to a surface of a first intermediate layer 202 and is used as an electrode on the front surface side of the first intermediate layer 202. A support (conductive support) 201 is used as an electrode on the back surface side of the first intermediate layer 202. A power supply 206 configured to apply a voltage between the copper tape 203 and the support 201 and a current measuring device 207 configured to measure a current flowing through the copper tape 203 and the support 201 are installed. To apply a voltage to the copper tape 203, a copper wire 204 is placed on the copper tape 203. A copper tape 205 the same as the copper tape 203 is bonded to the copper wire 204 in such a manner that the copper wire 204 does not protrude from the copper tape 203, thereby fixing the copper wire 204 to the copper tape 203. A voltage is applied to the copper tape 203 with the copper wire 204.

The volume resistivity ρ (Ω·cm) of the first intermediate layer 202 is determined from the following expression (3):

$$\rho=1/(I-I0)\times S/d(\Omega\cdot\mathrm{cm}) \quad (3)$$

where I0 represents a background current value (A) when no voltage is applied between the copper tape 203 and the support 201, I represents a current value (A) when only a direct-current voltage (direct-current component) of −1 V is applied, d represents the thickness (cm) of the first intermediate layer 202, and S represents the area (cm2) of the electrode (copper tape 203) on the front surface side of the first intermediate layer 202.

In this measurement, in order to measure a very small current of $1\times10^{-6}$ A or less in an absolute value, a device capable of measuring a very small current may be used as the current measuring device 207. Examples of the device include a pA meter (trade name: 4140B, manufactured by Yokogawa-Hewlett-Packard, Ltd.) and a high-resistance meter (trade name: 4339B, manufactured by Agilent Technologies, Inc).

The volume resistivity of the first intermediate layer may be measured with a sample in which only a first intermediate layer is formed on a conductive support. Alternatively, the volume resistivity of the first intermediate layer may be measured with a structure including only a first intermediate layer on a conductive support, the structure being formed by removing layers on the first intermediate layer from an electrophotographic photosensitive member. Also in this case, the same value is obtained.

Second Intermediate Layer

The second intermediate layer according to an embodiment of the present invention contains a cured product having electron transportability. The cured product is a three-dimensional crosslinked product having an electron transporting site as a moiety. Examples of the cured product having electron transportability include cured products prepared by curing compositions described below. Examples of the compositions include compositions each containing an electron transporting material having a polymerizable functional group and a crosslinking agent; and compositions each containing an electron transporting material having a polymerizable functional group, a crosslinking agent, and a resin having a polymerizable functional group.

The second intermediate layer may be formed as follows. A coating film of a second intermediate layer coating liquid containing the composition is formed and dried by heating to cure (polymerize) the composition, thereby forming the second intermediate layer.

From the viewpoint of inhibiting the occurrence of the pattern memory, the content of the electron transporting material having a polymerizable functional group may be 30% by mass or more and 70% by mass or less with respect to the total mass of the composition containing the electron transporting material having a polymerizable functional group, the crosslinking agent, and/or the resin having a polymerizable functional group.

The heating temperature when the coating film of the second intermediate layer coating liquid is dried by heating may be in the range of 100° C. to 200° C.

Electron Transporting Material

Examples of the electron transporting material contained in the cured product having electron transportability include quinone compounds, imide compounds, benzimidazol compounds, and cyclopentadienylidene compounds. The electron transporting material may be an electron transporting material having a polymerizable functional group. Examples of a polymerizable functional group include a hydroxy group, a thiol group, an amino group, a carboxy group, and a methoxy group. As specific examples of the electron transporting material, compounds represented by the following formulae (A1) to (A11) are exemplified below.

(A1)

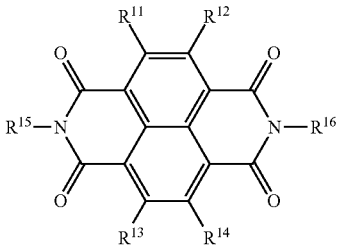

(A2)

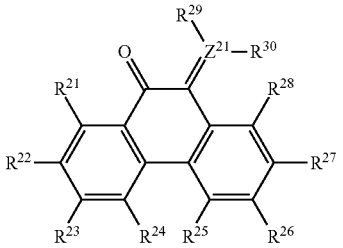

(A3)

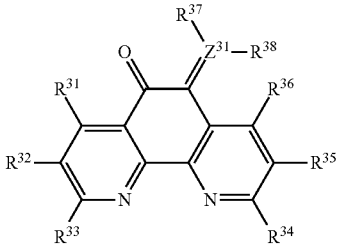

(A4)

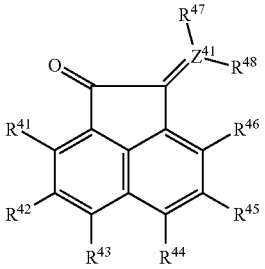

(A5)

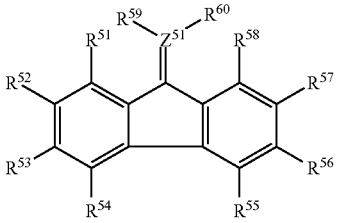

-continued (A6)

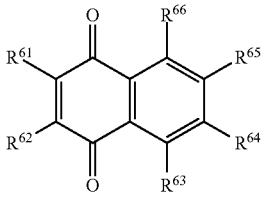

(A7)

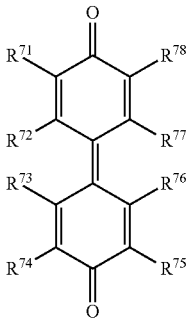

(A8)

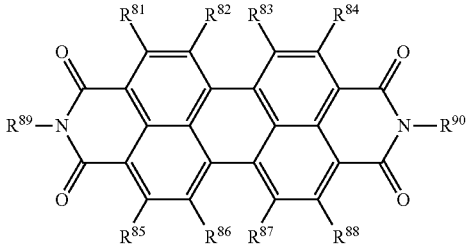

(A9)

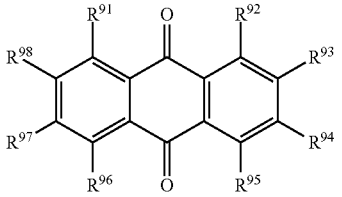

(A10)

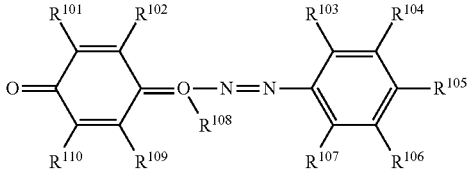

(A11)

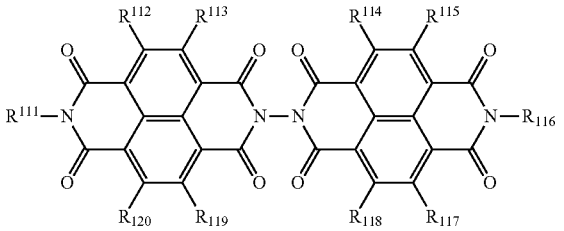

In the formulae (A1) to (A11), $R^{11}$ to $R^{16}$, $R^{21}$ to $R^{30}$, $R^{31}$ to $R^{38}$, $R^{41}$ to $R^{48}$, $R^{61}$ to $R^{60}$, $R^{61}$ to $R^{66}$, $R^{71}$ to $R^{78}$, $R^{81}$ to $R^{90}$, $R^{91}$ to $R^{98}$, $R^{101}$ to $R^{110}$, and $R^{111}$ to $R^{120}$ each independently represent a monovalent group represented by the following formula (A), a hydrogen atom, a cyano group, a nitro group, a halogen atom, an alkoxycarbonyl group, a substituted or unsubstituted alkyl group, a substituted or unsubstituted aryl group, or a substituted or unsubstituted heterocyclic group. One of the carbon atoms in the main chain of the alkyl group may be replaced with O, S, NH or $NR^{121}$ ($R^{121}$ represents an alkyl group). The substituent of the substituted alkyl group represents an alkyl group, an aryl group, a halogen atom, or an alkoxycarbonyl group. The substituent of the substituted aryl group and the substituent of the substituted heterocyclic group each represent a halogen atom, a nitro group, a cyano group, an alkyl group, a halogenated alkyl group, or an alkoxy group. $Z^{21}$, $Z^{31}$, $Z^{41}$, and $Z^{51}$ each independently represent a carbon atom, a nitrogen atom, or an oxygen atom. When $Z^{21}$ represents an oxygen atom, $R^{29}$ and $R^{30}$ are not present. When $Z^{21}$ represents a nitrogen atom, $R^{30}$ is not present. When $Z^{31}$ represents an oxygen atom, $R^{37}$ and $R^{38}$ are not present. When $Z^{31}$ represents a nitrogen atom, $R^{38}$ is not present. When $Z^{41}$ represents an oxygen atom, $R^{47}$ and $R^{48}$ are not present. When $Z^{41}$ represents a nitrogen atom, $R^{48}$ is not present. When $Z^{51}$ represents an oxygen atom, $R^{59}$ and $R^{60}$ are not present. When $Z^{12}$ represents a nitrogen atom, $R^{61}$ is not present.

$$-(\alpha)_l-(\beta)_m\gamma \quad \text{(A)}$$

In the formula (A), at least one of α, β, and γ represents a substituent-containing group. The substituent is at least one group selected from the group consisting of a hydroxy group, a thol group, an amino group, a carboxy group, and a methoxy group. l and m each independently represent 0 or 1, and the sum of l and m is 0 or more and 2 or less.

α represents an alkylene group having 1 to 6 main-chain atoms, an alkylene group having 1 to 6 main-chain atoms and being substituted with an alkyl group having 1 to 6 carbon atoms, an alkylene group having 1 to 6 main-chain atoms and being substituted with a benzyl group, an alkylene group having 1 to 6 main-chain atoms and being substituted with an alkoxycarbonyl group, or an alkylene group having 1 to 6 main-chain atoms and being substituted with a phenyl group. These groups each may contain, as a substituent, at least one group selected from the group consisting of a hydroxy group, a thiol group, an amino group, and a carboxy group. One of the carbon atoms in the main chain of the alkylene group may be replaced with 0, S, or $NR^{122}$ (wherein $R^{122}$ represents a hydrogen atom or an alkyl group).

β represents a phenylene group, a phenylene group substituted with an alkyl group having 1 to 6 carbon atoms, a phenylene group substituted with a nitro group, a phenylene group substituted with a halogen group, or a phenylene group substituted with an alkoxy group. These groups each may contain, as a substituent, at least one group selected from the group consisting of a hydroxy group, a thiol group, an amino group, a carboxy group, and a methoxy group.

γ represents a hydrogen atom, an alkyl group having 1 to 6 main-chain atoms, or an alkyl group having 1 to 6 main-chain atoms and being substituted with an alkyl group having 1 to 6 carbon atoms. These groups each may contain, as a substituent, at least one group selected from the group consisting of a hydroxy group, a thiol group, an amino group, a carboxy group, and a methoxy group. One of the carbon atoms in the main chain of the alkyl group may be replaced with O, S, or $NR^{123}$ (wherein $R^{123}$ represents a hydrogen atom or an alkyl group).

Among those electron transporting materials represented by the formulae (A1) to (A11), at least one of $R^{11}$ to $R^{16}$, at least one of $R^{21}$ to $R^{30}$, at least one of $R^{31}$ to $R^{38}$, at least one of $R^{41}$ to $R^{48}$, at least one of $R^{51}$ to $R^{60}$, at least one of $R^{61}$ to $R^{66}$, at least one of $R^{71}$ to $R^{78}$, at least one of $R^{81}$ to $R^{90}$, at least one of $R^{91}$ to $R^{98}$, at least one of $R^{101}$ to $R^{110}$, and at least one of $R^{111}$ to $R^{120}$ may each represent a monovalent group represented by the formula (A).

Specific examples of the electron transporting material having a polymerizable functional group will be illustrated below. In tables, Aa is represented by the same structural formula as A. Specific examples of the monovalent groups are illustrated in columns A and Aa. In the tables, when γ is expressed as "-", "-" refers to a hydrogen atom. The hydrogen atom represented by γ is included in a structure illustrated in column α or β.

TABLE 1

| Exemplified compound | $R^{11}$ | $R^{12}$ | $R^{13}$ | $R^{14}$ | $R^{15}$ | $R^{16}$ | A α | A β | A γ |
|---|---|---|---|---|---|---|---|---|---|
| A101 | H | H | H | H | 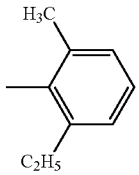 | A | 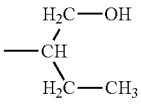 | — | — |
| A102 | H | H | H | H | 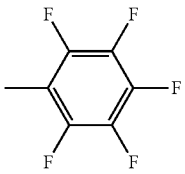 | A | 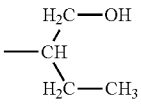 | — | — |
| A103 | H | H | H | H | 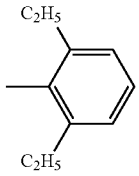 | A | — | 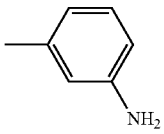 | — |

TABLE 1-continued
| Exemplified compound | $R^{11}$ | $R^{12}$ | $R^{13}$ | $R^{14}$ | $R^{15}$ | $R^{16}$ | A α | A β | A γ |
|---|---|---|---|---|---|---|---|---|---|
| A104 | H | H | H | H | 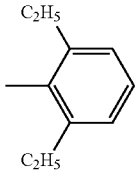 | A | — | 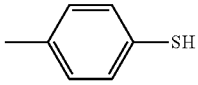 | — |
| A105 | H | H | H | H | 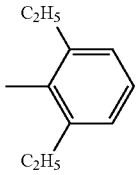 | A | — | 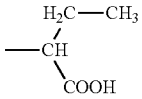 | — |
| A106 | H | H | H | H | A | A | 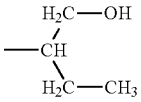 | — | — |
| A107 | H | H | H | H | A | A | 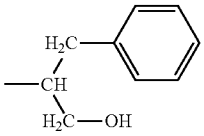 | — | — |
TABLE 2
| Exemplified compound | $R^{21}$ | $R^{22}$ | $R^{23}$ | $R^{24}$ | $R^{25}$ | $R^{26}$ | $R^{27}$ | $R^{28}$ | $R^{29}$ | $R^{30}$ | $Z^{21}$ | A α | A β | A γ |
|---|---|---|---|---|---|---|---|---|---|---|---|---|---|---|
| A201 | H | H | A | H | H | H | H | H | — | — | O | — | 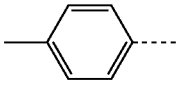 | ----$CH_2$—OH |
| A202 | H | H | H | H | H | H | H | H | A | — | N | — | 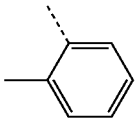 | $H_2C$—OH / ----$CH_2$ |
| A203 | H | H | 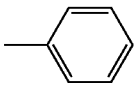 | H | H | 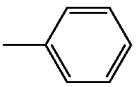 | H | H | A | — | N | — | 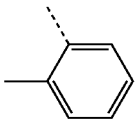 | $H_2C$—OH / ----$CH_2$ |
| A204 | H | H | 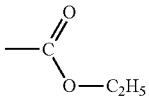 | H | H | 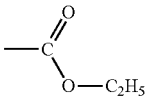 | H | H | A | — | N | — | 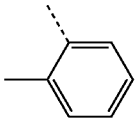 | $H_2C$—OH / ----$CH_2$ |
| A205 | H | H | A | H | H | A | H | H | — | — | O | — | 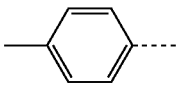 | ----$CH_2$—OH |
| A206 | H | A | H | H | H | H | A | H | — | — | O | — | 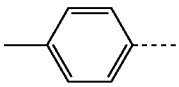 | ----$CH_2$—OH |

TABLE 3

| Exemplified compound | $R^{31}$ | $R^{32}$ | $R^{33}$ | $R^{34}$ | $R^{35}$ | $R^{36}$ | $R^{37}$ | $R^{38}$ | $Z^{31}$ | A α | A β | A γ |
|---|---|---|---|---|---|---|---|---|---|---|---|---|
| A301 | H | A | H | H | H | H | — | — | O | — | 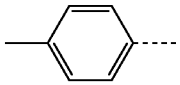 | ----$CH_2$—OH |
| A302 | H | H | H | H | H | H | A | — | N | — | 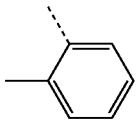 | $H_2C$—OH / ----$CH_2$ |
| A303 | H | H | H | H | H | H | A | — | N | $H_2C$—OH / —CH \ $H_2C$—$CH_3$ | — | — |
| A304 | H | H | Cl | Cl | H | H | A | — | N | — | 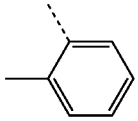 | $H_2C$—OH / ----$CH_2$ |
| A305 | H | A | H | H | A | H | CN | CN | C | — | 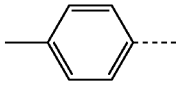 | ----$CH_2$—OH |

TABLE 4

| Exepmplified compound | $R^{41}$ | $R^{42}$ | $R^{43}$ | $R^{44}$ | $R^{45}$ | $R^{46}$ | $R^{47}$ | $R^{48}$ | $Z^{41}$ | A α | A β | A γ |
|---|---|---|---|---|---|---|---|---|---|---|---|---|
| A401 | H | H | A | H | H | H | CN | CN | C | — | 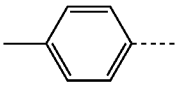 | ----$CH_2$—OH |
| A402 | H | H | H | H | H | H | A | — | N | — | 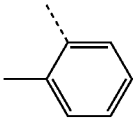 | $H_2C$—OH / ----$CH_2$ |
| A403 | H | H | A | A | H | H | CN | CN | C | — | 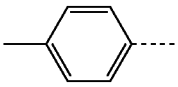 | ----$CH_2$—OH |
| A404 | H | H | A | A | H | H | CN | CN | C | — | 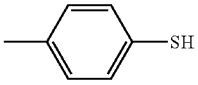 | — |
| A405 | H | H | A | A | H | H | — | — | O | — | 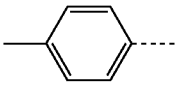 | ----$CH_2$—OH |

TABLE 5

| Exemplified compound | $R^{51}$ | $R^{52}$ | $R^{53}$ | $R^{54}$ | $R^{55}$ | $R^{56}$ | $R^{58}$ | $R^{58}$ | $R^{59}$ | $R^{60}$ | $Z^{51}$ | A α | A β | A γ |
|---|---|---|---|---|---|---|---|---|---|---|---|---|---|---|
| A501 | H | A | H | H | H | H | H | H | CN | CN | C | — | 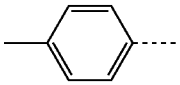 | —$CH_2$—OH |

TABLE 5-continued

| Exemplified compound | $R^{51}$ | $R^{52}$ | $R^{53}$ | $R^{54}$ | $R^{55}$ | $R^{56}$ | $R^{58}$ | $R^{58}$ | $R^{59}$ | $R^{60}$ | $Z^{51}$ | A α | A β | A γ |
|---|---|---|---|---|---|---|---|---|---|---|---|---|---|---|
| A502 | H | $NO_2$ | H | H | $NO_2$ | H | $NO_2$ | H | A | — | N | — | 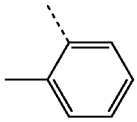 | $H_2C$—OH / ----$CH_2$ |
| A503 | H | A | H | H | H | H | A | H | CN | CN | C | $H_2C$—OH / —CH \ $H_2C$—$CH_3$ | 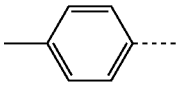 | — |
| A504 | H | H | A | H | H | A | H | H | CN | CN | C | — | | —$CH_2$—OH |

TABLE 6

| Exemplified compound | $R^{61}$ | $R^{62}$ | $R^{63}$ | $R^{64}$ | $R^{65}$ | $R^{66}$ | A α | A β | A γ |
|---|---|---|---|---|---|---|---|---|---|
| A601 | A | H | H | H | H | H | — | 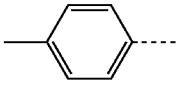 | —$CH_2$—OH |
| A602 | A | H | H | H | H | H | — | 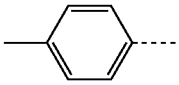 | —$CH_2$—OH |
| A603 | A | H | H | H | H | H | $H_2C$—OH / —CH \ $H_2C$—$CH_3$ | — | — |
| A604 | A | A | H | H | H | H | — | 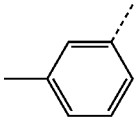 | —$CH_2$—OH |
| A605 | A | A | H | H | H | H | $H_2C$—OH / —CH \ $H_2C$—$CH_3$ | — | — |

TABLE 7

| Exemplified compound | $R^{71}$ | $R^{72}$ | $R^{73}$ | $R^{74}$ | $R^{75}$ | $R^{76}$ | $R^{77}$ | $R^{78}$ | A α | A β | A γ | Aa α | Aa β | Aa γ |
|---|---|---|---|---|---|---|---|---|---|---|---|---|---|---|
| A701 | A | H | H | H | H | H | H | H | — | 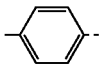 | —$CH_2$—OH | — | — | — |
| A702 | A | H | H | H | H | H | H | H | $H_2C$—OH / —CH \ $H_2C$—$CH_3$ | — | — | — | — | — |
| A703 | A | H | H | H | A | H | H | H | — | 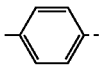 | —$CH_2$—OH | — | — | — |
| A704 | A | H | H | H | Aa | H | H | H | $H_2C$—OH / —CH \ $H_2C$—$CH_3$ | — | — | — | 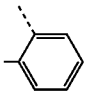 | —$CH_2$—OH |

TABLE 7-continued

| Exemplified compound | $R^{71}$ | $R^{72}$ | $R^{73}$ | $R^{74}$ | $R^{75}$ | $R^{76}$ | $R^{77}$ | $R^{78}$ | A α | A β | A γ | Aa α | Aa β | Aa γ |
|---|---|---|---|---|---|---|---|---|---|---|---|---|---|---|
| A705 | A | H | H | H | Aa | H | H | H | — | 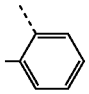 | —$CH_2$—OH | —$(CH_2)_5$—OH | — | — |

TABLE 8

| Exemplified compound | $R^{81}$ | $R^{82}$ | $R^{83}$ | $R^{84}$ | $R^{85}$ | $R^{86}$ | $R^{87}$ | $R^{88}$ | $R^{89}$ | $R^{90}$ | A α | A β | A γ |
|---|---|---|---|---|---|---|---|---|---|---|---|---|---|
| A801 | H | H | H | H | H | H | H | H | 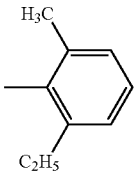 | A | 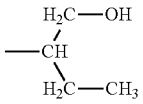 | — | — |
| A802 | H | H | H | H | H | H | H | H | 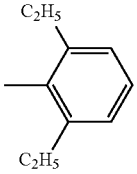 | A | — | 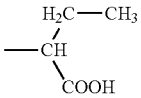 | — |
| A803 | H | CN | H | H | H | H | CN | H | 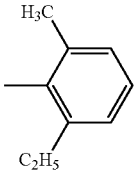 | A | 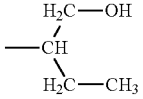 | — | — |
| A804 | H | H | H | H | H | H | H | H | A | A | 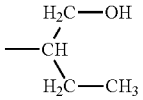 | — | — |
| A805 | H | H | H | H | H | H | H | H | A | A | — | 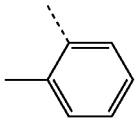 | 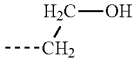 |

TABLE 9

| Exemplified compound | $R^{91}$ | $R^{92}$ | $R^{93}$ | $R^{94}$ | $R^{95}$ | $R^{96}$ | $R^{97}$ | $R^{98}$ | A α | A β | A γ |
|---|---|---|---|---|---|---|---|---|---|---|---|
| A901 | A | H | H | H | H | H | H | H | —$CH_2$—OH | — | — |
| A902 | A | H | H | H | H | H | H | H | —$(CH_2)_2$—OH | — | — |
| A903 | H | H | H | H | H | H | H | A | —$CH_2$—OH | — | — |
| A904 | H | H | H | H | H | H | H | A | —$(CH_2)_2$—OH | — | — |
| A905 | H | CN | H | H | H | H | CN | A | — | 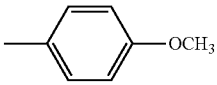 | — |

TABLE 9-continued

| Exemplified compound | $R^{91}$ | $R^{92}$ | $R^{93}$ | $R^{94}$ | $R^{95}$ | $R^{96}$ | $R^{97}$ | $R^{98}$ | A α | A β | A γ |
|---|---|---|---|---|---|---|---|---|---|---|---|
| A906 | A | A | H | $NO_2$ | H | H | $NO_2$ | H | $-(CH_2)_2-OH$ | — | — |

TABLE 10

| Exemplified compound | $R^{101}$ | $R^{102}$ | $R^{103}$ | $R^{104}$ | $R^{105}$ | $R^{106}$ | $R^{107}$ | $R^{108}$ | $R^{109}$ | $R^{110}$ | A α | A β | A γ |
|---|---|---|---|---|---|---|---|---|---|---|---|---|---|
| A1001 | $-C(CH_3)_3$ | H | H | H | A | H | H | H | H | $-C(CH_3)_3$ | $-CH_2-OH$ | — | — |
| A1002 | $-C(CH_3)_3$ | H | H | H | A | H | H | H | H | $-C(CH_3)_3$ | — | 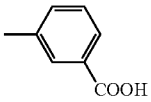 | — |
| A1003 | $-C(CH_3)_3$ | H | H | H | A | H | H | H | H | $-C(CH_3)_3$ | — | 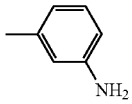 | — |
| A1004 | $-C(CH_3)_3$ | H | H | H | A | H | H | H | H | $-C(CH_3)_3$ | — | 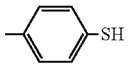 | — |
| A1005 | 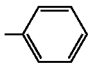 | H | H | H | A | H | H | H | H | 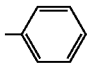 | $-CH_2-OH$ | — | — |

TABLE 11

| Exemplified compound | $R^{111}$ | $R^{112}$ | $R^{113}$ | $R^{114}$ | $R^{115}$ | $R^{116}$ | $R^{117}$ | $R^{118}$ | $R^{119}$ | $R^{120}$ | A α | A β | A γ |
|---|---|---|---|---|---|---|---|---|---|---|---|---|---|
| A1101 | A | H | H | H | H | A | H | H | H | H | $-CH(C_2H_5)-CH_2-OH$ | — | — |
| A1102 | A | H | H | H | H | A | H | H | H | H | 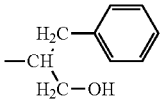 | — | — |
| A1103 | A | H | H | H | H | A | H | H | H | H | — | 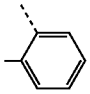 | $-CH_2-CH_2-OH$ |
| A1104 | A | H | H | H | H | 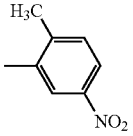 | H | H | H | H | 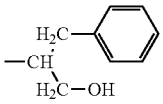 | — | — |
| A1105 | A | H | H | H | H | 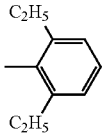 | H | H | H | H | $-CH(C_2H_5)-CH_2-OH$ | — | — |

A derivative (derivative of an electron transporting material) having a structure represented by the formula (A1) may be synthesized by a known synthesis method described in U.S. Pat. Nos. 4,442,193, 4,992,349, or 5,468,583, or Chemistry of materials, Vol. 19, No. 11, pp. 2703-2705 (2007). The derivative may be synthesized by a reaction between naphthalenetetracarboxylic dianhydride and a monoamine derivative, which are available from Tokyo Chemical Industry Co., Ltd., Sigma-Aldrich Japan K.K., or Johnson Matthey Japan Inc.

A compound represented by the formula (A1) contains a polymerizable functional group (a hydroxy group, a thiol group, an amino group, a carboxy group, or a methoxy group) that can be polymerized with a crosslinking agent. As a method for synthesizing a compound represented by the formula (A1) by introducing a polymerizable functional group into a derivative having a structure represented by the formula (A1), the following methods are exemplified. Examples thereof include a method in which after a derivative having a structure represented by the formula (A1) is synthesized, a polymerizable functional group is directly introduced; and a method in which a structure containing a polymerizable functional group or a functional group that can be formed into a precursor of a polymerizable functional group is introduced. Examples of the latter method are as follows: a method in which a functional group-containing aryl group is introduced into, for example, a halogenated naphthylimide derivative by, for example, a cross-coupling reaction using a palladium catalyst and a base; a method in which a functional group-containing alkyl group is introduced into a halogenated naphthylimide derivative by a cross-coupling reaction using a $FeCl_3$ catalyst and a base; and a method in which a hydroxyalkyl group or a carboxy group is introduced by subjecting a halogenated naphthylimide derivative to lithiation and then reaction with an epoxy compound or $CO_2$. There is a method in which a naphthalenetetracarboxylic dianhydride or a monoamide derivative containing a polymerizable functional group or a functional group to be formed into a precursor of a polymerizable functional group is used as a raw material for the synthesis of a naphthylimide derivative.

A derivative having a structure represented by the formula (A2) may be available from, for example, Tokyo Chemical Industry Co., Ltd., Sigma-Aldrich Japan K.K., or Johnson Matthey Japan Inc. Alternatively, the derivative may be synthesized from a phenanthrene derivative or a phenanthroline derivative by a synthesis method described in Chem. Educator No. 6, pp. 227-234 (2001), Journal of Synthetic Organic Chemistry, Japan, Vol. 15, pp. 29-32 (1957), or Journal of Synthetic Organic Chemistry, Japan, Vol. 15, pp. 32-34 (1957). A dicyanomethylene group may also be introduced by reaction with malononitrile.

A compound represented by the formula (A2) contains a polymerizable functional group (a hydroxy group, a thiol group, an amino group, a carboxy group, or a methoxy group) that can be polymerized with a crosslinking agent. As a method for synthesizing a compound represented by the formula (A2) by introducing a polymerizable functional group into a derivative having a structure represented by the formula (A2), the following methods are exemplified. Examples thereof include a method in which after a derivative having a structure represented by the formula (A2) is synthesized, a polymerizable functional group is directly introduced; and a method in which a structure containing a polymerizable functional group or a functional group that can be formed into a precursor of a polymerizable functional group is introduced. Examples of the latter method are as follows: a method in which a functional group-containing aryl group is introduced into a halogenated phenanthrenequinone by a cross-coupling reaction using a palladium catalyst and a base; a method in which a functional group-containing alkyl group is introduced into a halogenated phenanthrenequinone by a cross-coupling reaction using a $FeCl_3$ catalyst and a base; and a method in which a hydroxyalkyl group or a carboxy group is introduced by subjecting a halogenated phenanthrenequinone to lithiation and then reaction with an epoxy compound or $CO_2$.

A derivative having a structure represented by the formula (A3) may be available from, for example, Tokyo Chemical Industry Co., Ltd., Sigma-Aldrich Japan K.K., or Johnson Matthey Japan Inc. Alternatively, the derivative may be synthesized from a phenanthrene derivative or a phenanthroline derivative by a synthesis method described in Bull. Chem. Soc. Jpn., Vol. 65, pp. 1006-1011 (1992). A dicyanomethylene group may also be introduced by reaction with malononitrile.

A compound represented by the formula (A3) contains a polymerizable functional group (a hydroxy group, a thiol group, an amino group, a carboxy group, or a methoxy group) that can be polymerized with a crosslinking agent. As a method for synthesizing a compound represented by the formula (A3) by introducing a polymerizable functional group into a derivative having a structure represented by the formula (A3), the following methods are exemplified. Examples thereof include a method in which after a derivative having a structure represented by the formula (A3) is synthesized, a polymerizable functional group is directly introduced; and a method in which a structure containing a polymerizable functional group or a functional group that can be formed into a precursor of a polymerizable functional group is introduced. Examples of the latter method are as follows: a method in which a functional group-containing aryl group is introduced into a halogenated phenanthrolinequinone by a cross-coupling reaction using, for example, a palladium catalyst and a base; a method in which a functional group-containing alkyl group is introduced into a halogenated phenanthrolinequinone by a cross-coupling reaction using a $FeCl_3$ catalyst and a base; a method in which a hydroxyalkyl group or a carboxy group is introduced by subjecting a halogenated phenanthrolinequinone to lithiation and then reaction with an epoxy compound or $CO_2$.

A derivative having a structure represented by the formula (A4) may be available from, for example, Tokyo Chemical Industry Co., Ltd., Sigma-Aldrich Japan K.K., or Johnson Matthey Japan Inc. Alternatively, the derivative may be synthesized from an acenaphthenequinone derivative by a synthetic method described in Tetrahedron Letters, Vol. 43, issue 16, pp. 2991-2994 (2002) or Tetrahedron Letters, Vol. 44, issue 10, pp. 2087-2091 (2003). A dicyanomethylene group can also be introduced by reaction with malononitrile.

A compound represented by the formula (A4) contains a polymerizable functional group (a hydroxy group, a thiol group, an amino group, a carboxy group, or a methoxy group) that can be polymerized with a crosslinking agent. As a method for synthesizing a compound represented by the formula (A4) by introducing a polymerizable functional group into a derivative having a structure represented by the formula (A4), the following methods are exemplified. Examples thereof include a method in which after a derivative having a structure represented by the formula (A4) is derived, a polymerizable functional group is directly introduced; and a method in which a structure containing a polymerizable functional group or a functional group that can be formed into a precursor of a polymerizable functional group is introduced. Examples of the latter method are as follows: a method in which a functional group-containing aryl group is introduced into, for example, a halogenated acenaphthenequinone by a cross-coupling reaction using, for example, a palladium catalyst and a base; a method in which a functional group-containing alkyl group is introduced into a halogenated acenaphthenequinone by a cross-coupling reaction using a $FeCl_3$ catalyst and a base; and a method in which a hydroxyalkyl group or a carboxy group is introduced by subjecting a halogenated acenaphthenequinone to lithiation and then reaction with an epoxy compound or $CO_2$.

A derivative having a structure represented by the formula (A5) may be available from, for example, Tokyo Chemical Industry Co., Ltd., Sigma-Aldrich Japan K.K., or Johnson Matthey Japan Inc. Alternatively, the derivative may be synthesized from a fluorenone derivative and malononitrile by a synthesis method described in U.S. Pat. No. 4,562,132. In addition, the derivative may be synthesized from a fluorenone derivative and an aniline derivative by a synthesis method described in Japanese Patent Laid-Open No. 1993-279582 or 1995-70038.

A compound represented by the formula (A5) contains a polymerizable functional group (a hydroxy group, a thiol group, an amino group, a carboxy group, or a methoxy group) that can be polymerized with a crosslinking agent. As a method for synthesizing a compound represented by the formula (A5) by introducing a polymerizable functional group into a derivative having a structure represented by the formula (A5), the following methods are exemplified. Examples thereof include a method in which after a derivative having a structure represented by the formula (A5) is synthesized, a polymerizable functional group is directly introduced; and a method in which a structure containing a polymerizable functional group or a functional group that can be formed into a precursor of a polymerizable functional group is introduced. Examples of the latter method are as follows: a method in which a functional group-containing aryl group is introduced into, for example, a halogenated fluorenone by a cross-coupling reaction using, for example, a palladium catalyst and a base; a method in which a functional group-containing alkyl group is introduced into a halogenated fluorenone by a cross-coupling reaction using a $FeCl_3$ catalyst and a base; and a method in which a hydroxyalkyl group or a carboxy group is introduced by subjecting a halogenated fluorenone to lithiation and then reaction with an epoxy compound or $CO_2$.

A derivative having a structure represented by the formula (A6) may be synthesized by a synthesis method described in, for example, Chemistry Letters, 37(3), pp. 360-361 (2008) or Japanese Patent Laid-Open No. 1997-151157. Alternatively, the derivative may be available from Tokyo Chemical Industry Co., Ltd., Sigma-Aldrich Japan K.K., or Johnson Matthey Japan Inc.

A compound represented by the formula (A6) contains a polymerizable functional group (a hydroxy group, a thiol group, an amino group, a carboxy group, or a methoxy group) that can be polymerized with a crosslinking agent. As a method for synthesizing a compound represented by the formula (A6) by introducing a polymerizable functional group into a derivative having a structure represented by the formula (A6), the following methods are exemplified. Examples thereof include a method in which after a derivative having a structure represented by the formula (A6) is synthesized, a polymerizable functional group is directly introduced; and a method in which a structure containing a polymerizable functional group or a functional group that can be formed into a precursor of a polymerizable functional group is introduced. Examples of the latter method are as follows: a method in which a functional group-containing aryl group is introduced into, for example, a halogenated naphthoquinone by a cross-coupling reaction using, for example, a palladium catalyst and a base; a method in which a functional group-containing alkyl group is introduced into a halogenated naphthoquinone by a cross-coupling reaction using a $FeCl_3$ catalyst and a base; and a method in which a hydroxyalkyl group or a carboxy group is introduced by subjecting a halogenated naphthoquinone to lithiation and then reaction with an epoxy compound or $CO_2$.

A derivative having a structure represented by the formula (A7) may be synthesized by a synthesis method described in Japanese Patent Laid-Open No. 1989-206349 or the proceedings of PPCI/Japan Hardcopy '98, p. 207 (1998). For example, the derivative may be synthesized from a phenol derivative, which is available from Tokyo Chemical Industry Co., Ltd. or Sigma-Aldrich Japan K.K., serving as a raw material.

A compound represented by the formula (A7) contains a polymerizable functional group (a hydroxy group, a thiol group, an amino group, a carboxy group, or a methoxy group) that can be polymerized with a crosslinking agent. As a method for synthesizing a compound represented by the formula (A7) by introducing a polymerizable functional group into a derivative having a structure represented by the formula (A7), the following method is exemplified. An example thereof is a method in which after a derivative having a structure represented by the formula (A7) is synthesized, a structure containing a polymerizable functional group or a functional group that can be formed into a precursor of a polymerizable functional group is introduced. Examples of the method include a method in which a functional group-containing aryl group is introduced into, for example, a halogenated diphenoquinone by a cross-coupling reaction using, for example, a palladium catalyst and a base; a method in which a functional group-containing alkyl group is introduced into a halogenated diphenoquinone by a cross-coupling reaction using a $FeCl_3$ catalyst and a base; and a method in which a hydroxyalkyl group or a carboxy group is introduced by subjecting a halogenated diphenoquinone to lithiation and then reaction with an epoxy compound or $CO_2$.

A derivative having a structure represented by the formula (A8) may be synthesized by a known synthesis method described in, for example, Journal of the American chemical society, Vol. 129, No. 49, pp. 15259-78 (2007). For example, the derivative may be synthesized by a reaction between perylenetetracarboxylic dianhydride and a monoamine derivative, which are available from Tokyo Chemical Industry Co., Ltd., Sigma-Aldrich Japan K.K., or Johnson Matthey Japan Inc.

A compound represented by the formula (A8) contains a polymerizable functional group (a hydroxy group, a thiol group, an amino group, a carboxy group, or a methoxy group) that can be polymerized with a crosslinking agent. As a method for synthesizing a compound represented by the formula (A8) by introducing a polymerizable functional group into a derivative having a structure represented by the formula (A8), the following methods are exemplified. Examples thereof include a method in which after a derivative having a structure represented by the formula (A8) is synthesized, a polymerizable functional group is directly introduced; and a method in which a structure containing a polymerizable functional group or a functional group that can be formed into a precursor of a polymerizable functional group is introduced. Examples of the latter method are as follows: a method in which a cross-coupling reaction of a halogenated perylene-imide derivative is used with a palladium catalyst and a base; and a method in which a cross-coupling reaction of a halogenated perylene-imide derivative is used with a $FeCl_3$ catalyst and a base. There is a method in which a perylenetetracarboxylic dianhydride derivative or a monoamine derivative containing the polymerizable functional group or a functional group that can be formed into a precursor of the polymerizable functional group is used as a raw material for the synthesis of the perylene-imide derivative.

A derivative having a structure represented by the formula (A9) may be available from, for example, Tokyo Chemical Industry Co., Ltd., Sigma-Aldrich Japan K.K., or Johnson Matthey Japan Inc.

A compound represented by the formula (A9) contains a polymerizable functional group (a hydroxy group, a thiol group, an amino group, a carboxy group, or a methoxy group) that can be polymerized with a crosslinking agent. As a method for synthesizing a compound represented by the formula (A9) by introducing a polymerizable functional group into a derivative having a structure represented by the formula (A9), the following method is exemplified. An example thereof is a method in which a structure containing a polymerizable functional group or a functional group that can be formed into a precursor of a polymerizable functional group is introduced into a derivative having a structure represented by the formula (A9). Examples of the method include a method in which a functional group-containing aryl group is introduced into, for example, a halogenated anthraquinone by a cross-coupling reaction using, for example, a palladium catalyst and a base; a method in which a functional group-containing alkyl group is introduced into a halogenated anthraquinone by a cross-coupling reaction using a $FeCl_3$ catalyst and a base; and a method in which a hydroxyalkyl group or a carboxy group is introduced by subjecting a halogenated anthraquinone to lithiation and then reaction with an epoxy compound or $CO_2$.

A derivative having a structure represented by the formula (A10) may be synthesized by a synthesis method described in, for example, in Japanese Patent No. 3717320. Specifically, the derivative may be synthesized by oxidizing the phenol derivative having hydorazone with an oxidant in an organic solvent. An example of the oxidant is potassium permanganate. An example of the organic solvent is chloroform. The phenol derivative having hydorazone may be synthesized by, for example, a reaction between a phenylhydrazine derivative and a, hydroxy benzoic aldehyde derivative, which are available from Tokyo Chemical Industry Co., Ltd., Sigma-Aldrich Japan K.K., or Johnson Matthey Japan Inc.

A compound represented by the formula (A10) contains a polymerizable functional group (a hydroxy group, a thiol group, an amino group, a carboxy group, or a methoxy group) that can be polymerized with a crosslinking agent. As a method for synthesizing a compound represented by the formula (A10) by introducing a polymerizable functional group into a derivative having a structure represented by the formula (A10), the following method is exemplified. An example thereof is a method in which after a derivative having a structure represented by the formula (A10) is synthesized, a structure containing a polymerizable functional group or a functional group that can be formed into a precursor of a polymerizable functional group is introduced. Examples of the method include a method in which a functional group-containing aryl group is introduced into, for example, a halogenated phenol derivative having hydorazone structure by a cross-coupling reaction using, for example, a palladium catalyst and a base; a method in which a functional group-containing alkyl group is introduced into a halogenated phenol derivative having hydorazone structure by a cross-coupling reaction using a $FeCl_3$ catalyst and a base; and a method in which a hydroxyalkyl group or a carboxy group is introduced by subjecting a halogenated phenol derivative having hydorazone structure to lithiation and then reaction with an epoxy compound or $CO_2$.

A derivative having a structure represented by the formula (A11) may be synthesized by a known synthesis method described in, for example, Japanese Patent Laid-Open No. 2007-108670 or J. Imaging Soc. Japan 2006, 45(6), 521-525. The derivative may also be synthesized by the reaction of naphthalenetetracarboxylic dianhydride, a monoamine derivative, and hydrazine available from Tokyo Chemical Industry Co., Ltd., Sigma-Aldrich Japan K.K., or Johnson Matthey Japan Inc.

A compound represented by the formula (A11) contains a polymerizable functional group (a hydroxy group, a thiol group, an amino group, a carboxy group, or a methoxy group) that can be polymerized with a crosslinking agent. As a method for synthesizing a compound represented by the formula (A11) by introducing a polymerizable functional group into a derivative having a structure represented by the formula (A11), the following methods are exemplified. Examples thereof include a method in which after a derivative having a structure represented by the formula (A11) is synthesized, a polymerizable functional group is directly introduced; and a method in which a structure containing a polymerizable functional group or a functional group that can be formed into a precursor of a polymerizable functional group is introduced. Examples of the latter method are as follows: a method in which a functional group-containing alkyl group is introduced into a halogenated naphthylimide derivative by a cross-coupling reaction using a $FeCl_3$ catalyst and a base; and a method in which a hydroxyalkyl group or a carboxy group is introduced by subjecting a halogenated naphthylimide derivative to lithiation and then reaction with an epoxy compound or $CO_2$.

The electron transporting material having a polymerizable functional group may contain two or more polymerizable functional groups in its molecule.

Crosslinking Agent

The crosslinking agent will be described below.

As the crosslinking agent, a compound that can be polymerized or crosslinked with the electron transporting material having a polymerizable functional group and the resin having a polymerizable functional group may be used. Specifically, a compound described in Kakyouzai Handbook (Crosslinking Agent), edited by Shinzo Yamashita and Tosuke Kaneko, published by Taiseisya Ltd. (1981) may be used. For example, an isocyanate compound or an amine compound may be used. In particular, a crosslinking agent (an isocyanate compound or an amine compound) containing 3 to 6 isocyanate groups, blocked isocyanate groups, or monovalent groups each represented by $—CH_2—OR^1$ may be used.

As the isocyanate compound, an isocyanate compound containing 3 to 6 isocyanate groups or blocked isocyanate groups may be used. The isocyanate compound may have a molecular weight of 200 to 1300.

Each of the blocked isocyanate groups has a structure of $—NHCOX^1$ ($X^1$ represents a protective group). As the protective group $X^1$, any protective group that can be introduced into the isocyanate group may be used. Specifically, groups represented by the following formulae (H1) to (H7) may be used.

(H1)

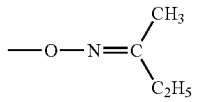

(H2)

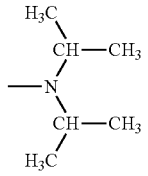

(H3)

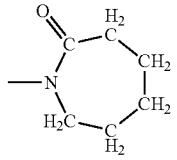

-continued (H4)

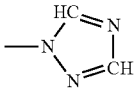

(H5)

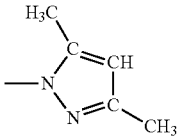

(H6)

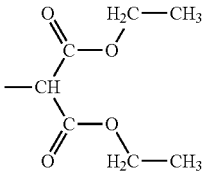

-continued (H7)

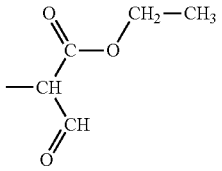

Examples of the isocyanate compound include triisocyanatobenzene, triisocyanatobenzene, triphenylmethane triisocyanate, and lysine triisocyanate; isocyanurate, biuret, and allophanate modifications of diisocyanates, such as tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl-2,6-diisocyanatehexanoate, and norbornene diisocyanate; and adduct modifications of these diisocyanates with trimethylolpropane and pentaerythritol.

Specific examples of the isocyanate compound are illustrated below.

(B1)

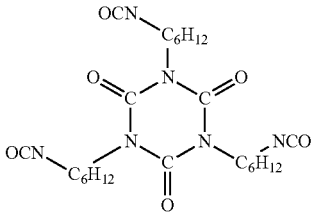

(B2)

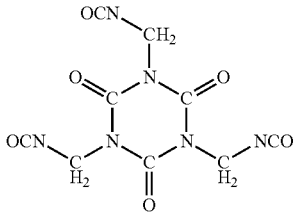

(B3)

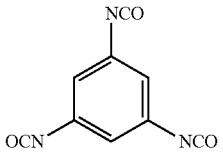

(B4)

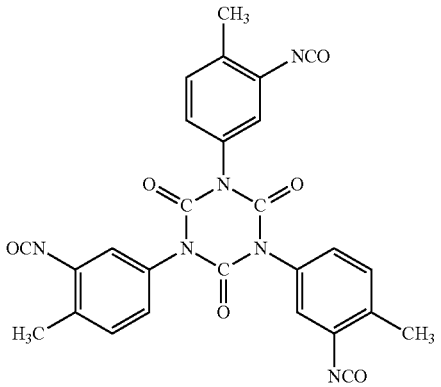

(B5)

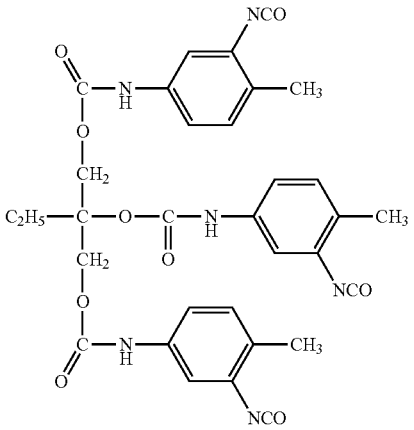

(B6)

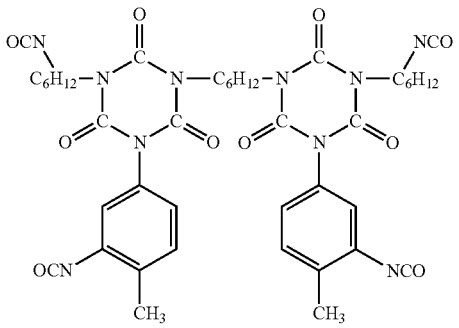

-continued
(B7)
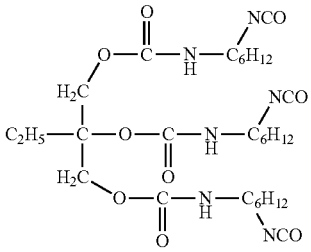
(B8)
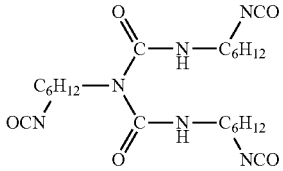
(B9)
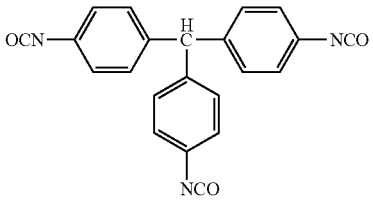
(B10)
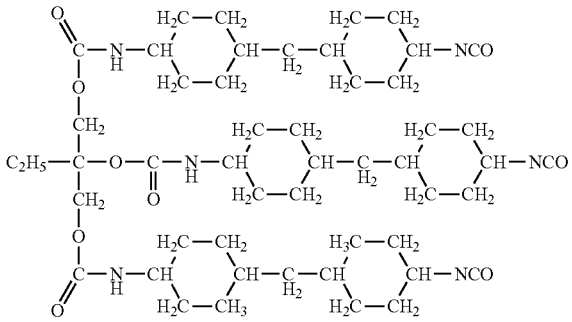
(B11)
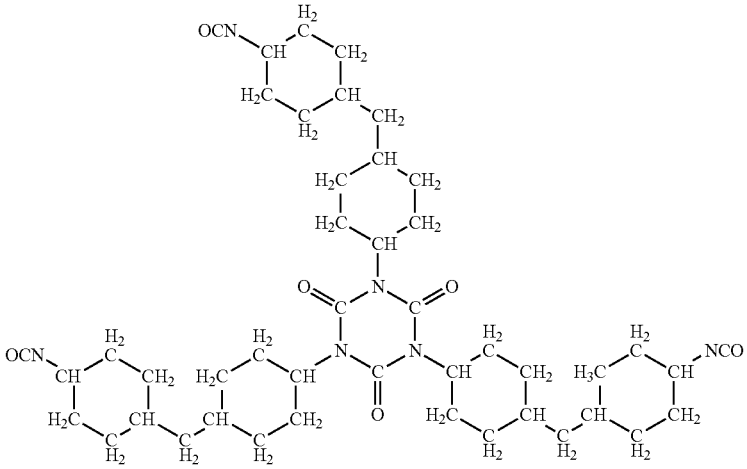
(B12)
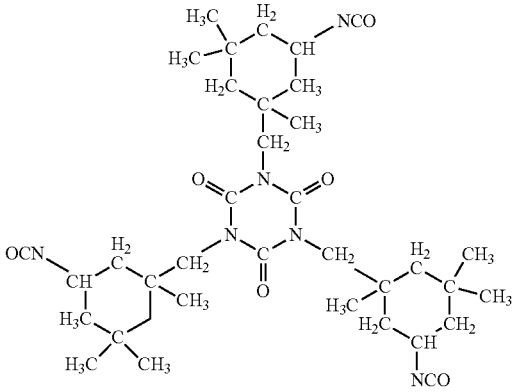
(B13)
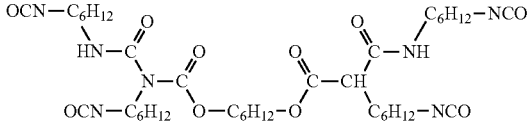

-continued
(B14)
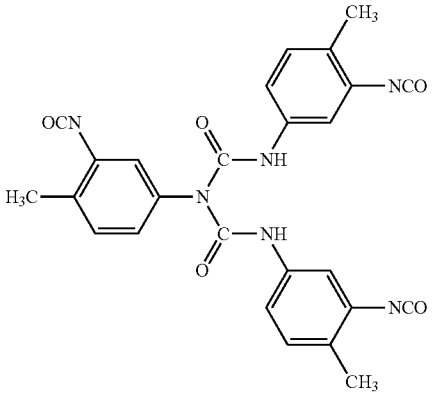
(B15)
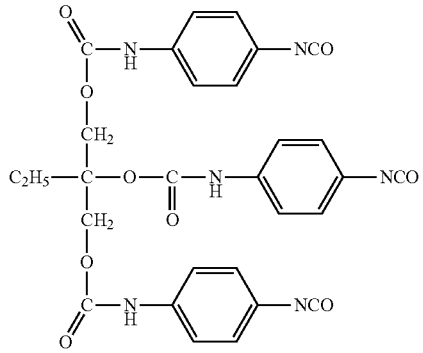
(B16)
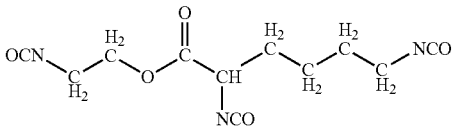
(B17)
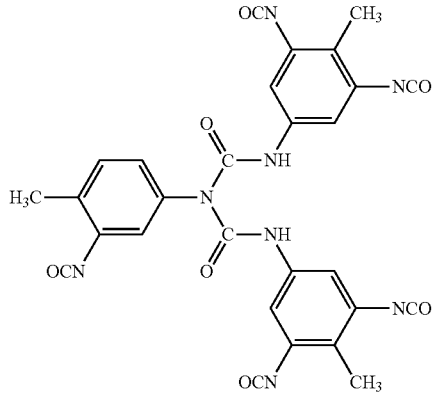
(B18)
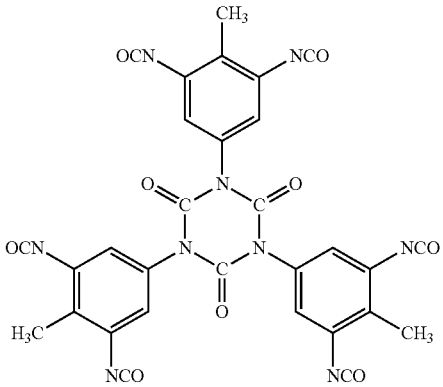
(B19)
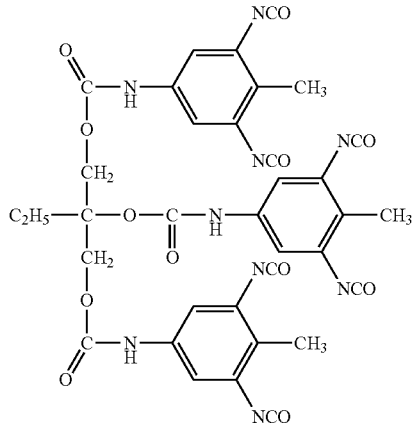
(B20)
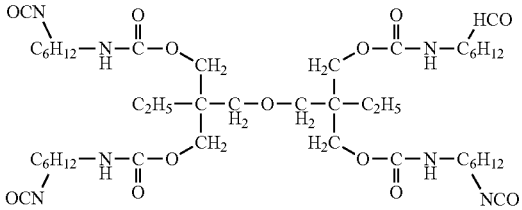
(B21)
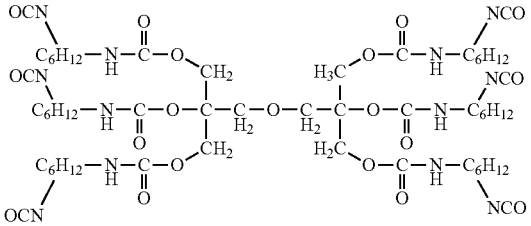
As the amine compound, a compound represented by any one of the following formulae (C1) to (C5) or an oligomer of a compound represented by any one of the formulae (C1) to (C5) may be used. Each of the compounds may have a molecular weight of 200 to 1000. Specifically, a melamine compound represented by the formula (C1) or a guanamine compound represented by the formula (C2) may be used.

(C1)

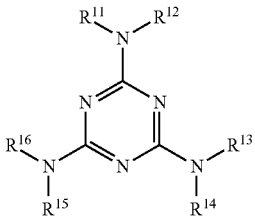

(C2)

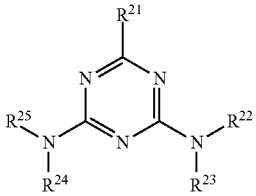

(C3)

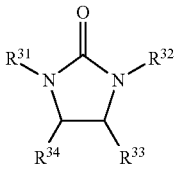

(C4)

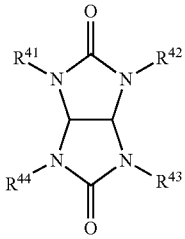

(C5)

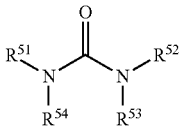

In the formulae (C1) to (C5), $R^{11}$ to $R^{16}$, $R^{22}$ to $R^{25}$, $R^{31}$ to $R^{34}$, $R^{41}$ to $R^{44}$, and $R^{51}$ to $R^{54}$ each independently represent a hydrogen atom, a hydroxy group, an acyl group, or a monovalent group represented by $CH_2$—$OR^1$. At least one of $R^{11}$ to $R^{16}$, at least one of $R^{22}$ to $R^{25}$, at least one of $R^{31}$ to $R^{34}$, at least one of $R^{41}$ to $R^{44}$, and at least one of $R^{51}$ to $R^{54}$ each represent a monovalent group represented by —$CH_2$—$OR^1$. $R^1$ represents a hydrogen atom or an alkyl group having 1 to 10 carbon atoms. As the alkyl group, a methyl group, an ethyl group, a propyl group (a n-propyl group or an isopropyl group), a butyl group (a n-butyl group, an isobutyl group, or a tert-butyl group) may be used in view of polymerizability. $R^{21}$ represents an aryl group, an aryl group substituted with an alkyl group, a cycloalkyl group, or a cycloalkyl group substituted with an alkyl group.

Specific examples of the compounds represented by the formulae (C1) to (C5) are illustrated below. Oligomers (multimers) of the compounds represented by the formulae (C1) to (C5) may be contained. The oligomers and the monomers may be used in combination as a mixture.

Examples of the compound represented by the formula (C1) include SUPER MELAMI No. 90 (manufactured by NOF Corporation), SUPER BECKAMIN (R) TD-139-60, L-105-60, L127-60, L110-60, J-820-60, and G-821-60 (manufactured by DIC Inc.), UBAN 2020 (manufactured by Mitsui Chemicals, Inc.), SUMITEX RESIN M-3 (manufactured by Sumitomo Chemical Co., Ltd.), and NIKALACK MW-30, MW-390, and MX-750LM (manufactured by Nippon Carbide Industries Co., Inc). Examples of the compound represented by the formula (C2) include SUPER BECKAMIN (R) L-148-55, 13-535, L-145-60, TD-126 (manufactured by DIC Inc.), and NIKALACK BL-60 and BX-4000 (manufactured by Nippon Carbide Industries Co., Inc). Examples of the compound represented by the formula (C3) include NIKALACK MX-280 (manufactured by Nippon Carbide Industries Co., Inc). Examples of the compound represented by the formula (C4) include NIKALACK MX-270 (manufactured by Nippon Carbide Industries Co., Inc). Examples of the compound represented by the formula (C5) include NIKALACK MX-290 (manufactured by Nippon Carbide Industries Co., Inc).

(C1-1)

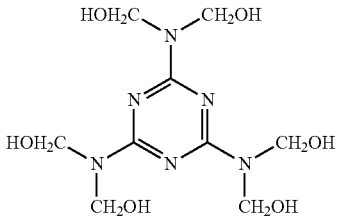

(C1-2)

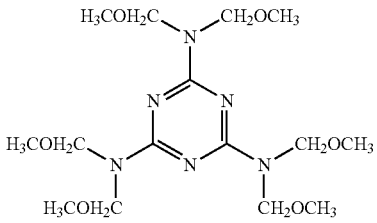

(C1-3)

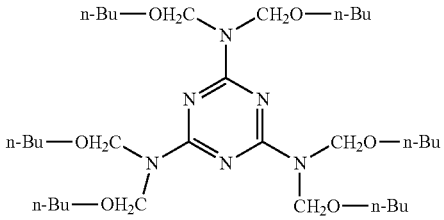

(C1-4)

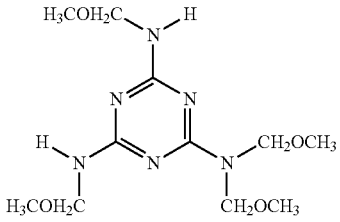

(C1-5)

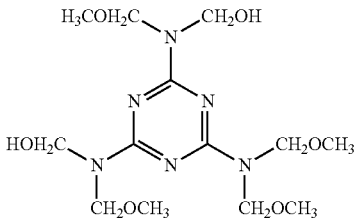

-continued
(C1-6)
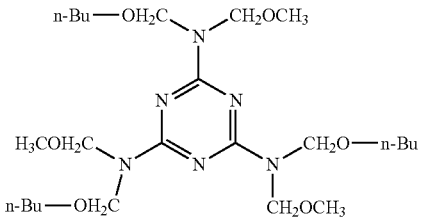
(C2-1)
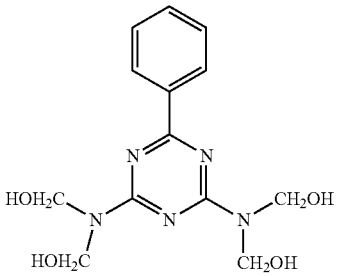
(C2-2)
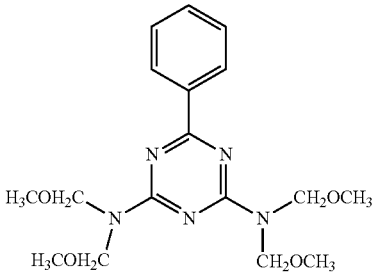
(C2-3)
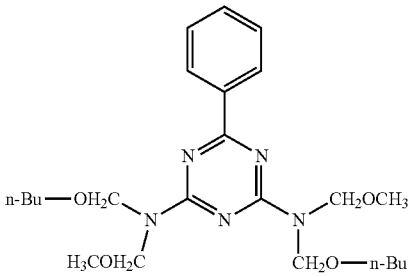
(C2-4)
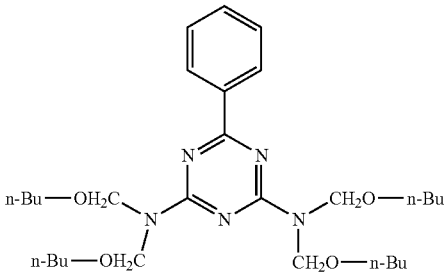
(C2-5)
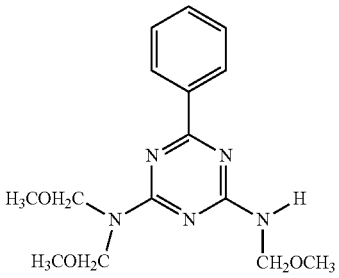
-continued
(C2-7)
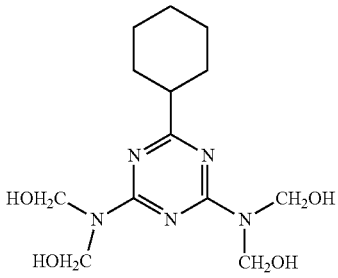
(C2-8)
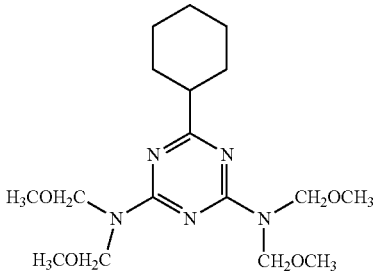
(C2-9)
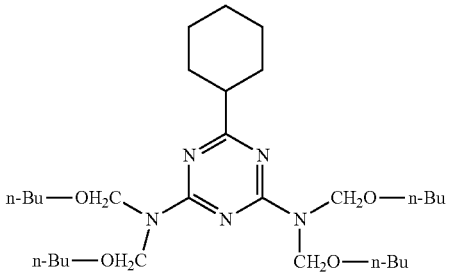
(C2-10)
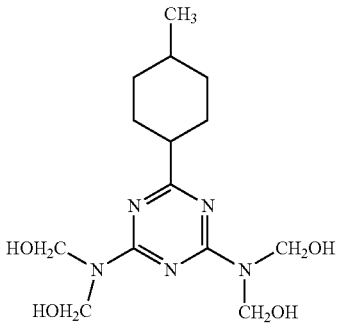
(C2-11)
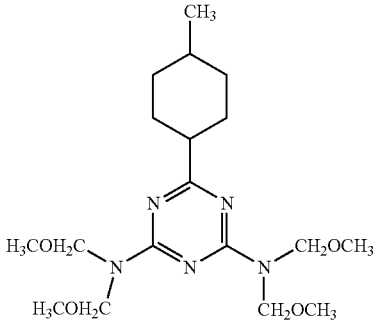

-continued
(C2-12)
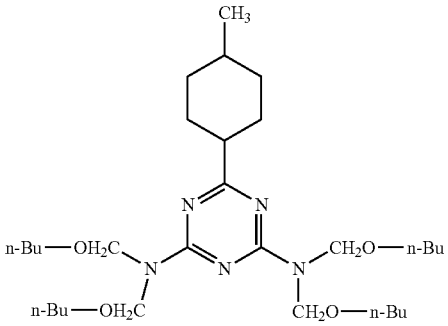
(C2-13)
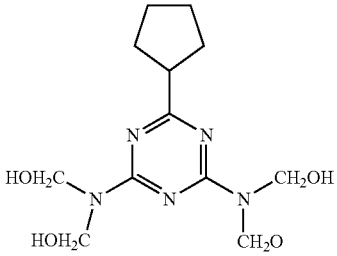
(C2-14)
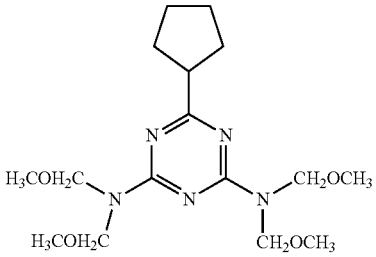
(C2-15)
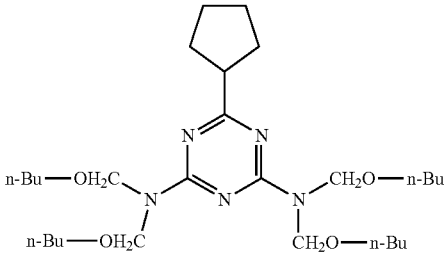
(C2-16)
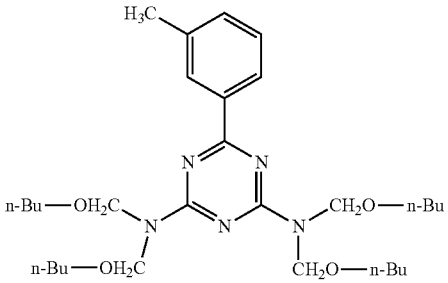
-continued
(C2-17)
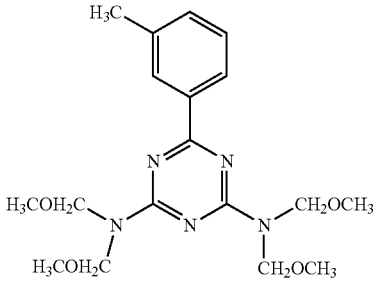
(C2-18)
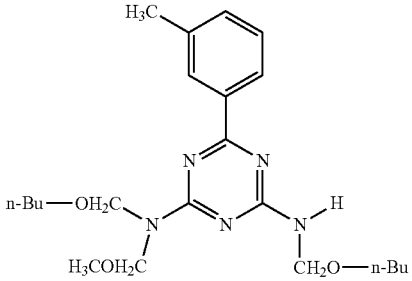
(C3-1)
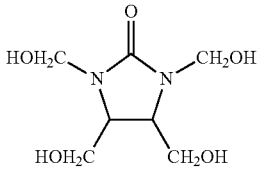
(C3-2)
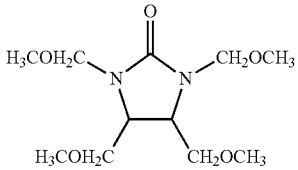
(C3-3)
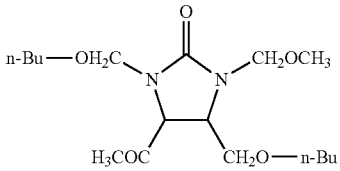
(C3-4)
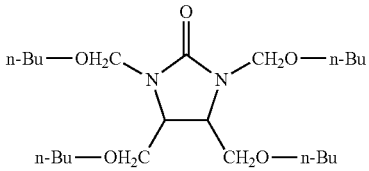
(C3-5)
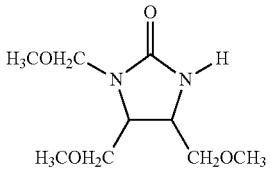

-continued (C3-6)

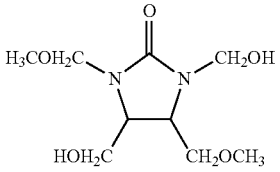

(C4-1)

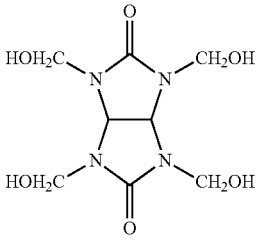

(C4-2)

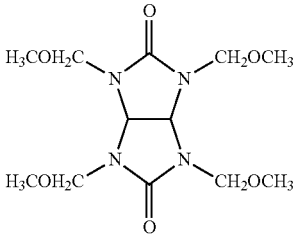

(C4-3)

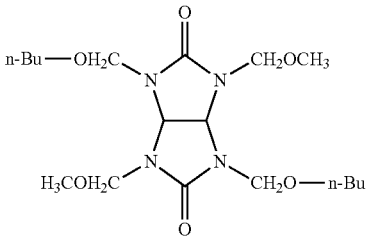

(C4-4)

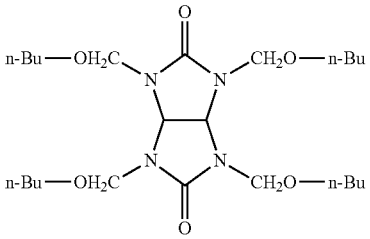

(C4-5)

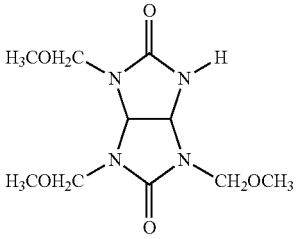

-continued (C4-6)

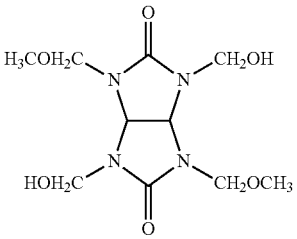

(C5-1)

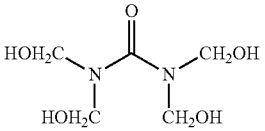

(C5-2)

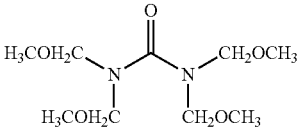

(C5-3)

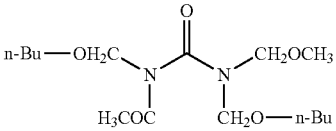

(C5-4)

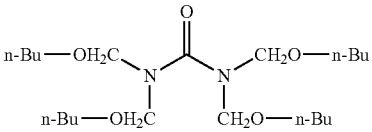

(C5-5)

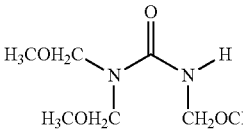

(C5-6)

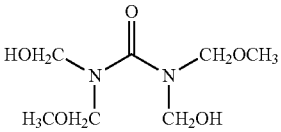

Resin

The resin having a polymerizable functional group will be described below. Examples of the resin having a polymerizable functional group include resins each having a structural unit represented by the formula (D).

(D)

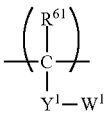

In the formula, $R^{61}$ represents a hydrogen atom or an alkyl group. $Y^1$ represents a single bond, an alkylene group, or a phenylene group. $W^1$ represents a hydroxy group, a thiol group, an amino group, a carboxy group, or a methoxy group.

Examples of the resin having a structural unit represented by the formula (D) include acetal resins, polyolefin resins, polyester resins, polyether resins, and polyamide resins. Such a resin further has characteristic structure illustrated below, besides the structural unit represented by the formula (D). The characteristic structures are represented by the following formulae (E-1) to (E-5). The formula (E-1) represents a structural unit of an acetal resin. The formula (E-2) represents a structural unit of a polyolefin resin. The formula (E-3) represents a surface treatment of a polyester resin. The formula (E-4) represents a surface treatment of a polyether resin. The formula (E-5) represents a structural unit of a polyamide resin.

(E-1)

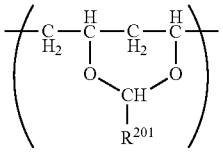

(E-2)

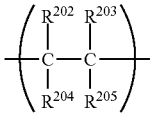

(E-3)

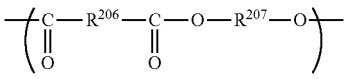

(E-4)

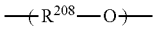

(E-5)

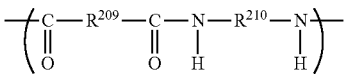

In the formulae, $R^{201}$ to $R^{205}$ each independently represent a substituted or unsubstituted alkyl group or a substituted or unsubstituted aryl group. $R^{206}$ to $R^{210}$ each independently represent a substituted or unsubstituted alkylene group or a substituted or unsubstituted arylene group. When $R^{201}$ represents $C_3H_7$, the characteristic structure is expressed as butyral.

The resin having a structural unit represented by the formula (D) (hereinafter, also referred to as "resin D") may be prepared by the polymerization of a polymerizable functional group-containing monomer available from, for example, Sigma-Aldrich Japan K.K. or Tokyo Chemical Industry Co., Ltd.

Examples of a commercially available resin include polyether polyol-based resins, such as AQD-457 and AQD-473, manufactured by Nippon Polyurethane Industry Co., Ltd., and SANNIX GP-400 and GP-700, manufactured by Sanyo Chemical Industries, Ltd.; polyester polyol-based resins, such as PHTHALKYD W2343, manufactured by Hitachi Chemical Company, Ltd., Watersol S-118 and CD-520, and BECKOLITE M-6402-50 and M-6201-40IM, manufactured by DIC Corporation, HARIDIP WH-1188, manufactured by Harima Chemicals Group, Inc., and aES3604 and ES6538, manufactured by Japan U-PiCA Company, Ltd.; polyacrylic polyol-based resins, such as BURNOCK WE-300 and WE-304, manufactured by DIC Corporation; polyvinyl alcohol-based resins, such as KURARAY POVAL PVA-203, manufactured by Kuraray Co., Ltd.; polyvinyl acetal-based resins, such as BX-1 and BM-1, manufactured by Sekisui Chemical Co., Ltd.; polyamide-based resins, such as Toresin FS-350, manufactured by Nagase ChemteX Corporation; carboxy group-containing resins, such as AQUALIC, manufactured by Nippon Shokubai Co., Ltd., and FINELEX SG2000, manufactured by Namariichi Co., Ltd.; polyamine resins, such as LUCKAMIDE, manufactured by DIC Corporation; and polythiol resins, such as QE-340M, manufactured by Toray Industries, Inc. Of these, polyvinyl acetal-based resins and polyester polyol-based resins may be used in view of polymerizability and uniformity in the undercoat layer.

Resin D may have a weight-average molecular weight (Mw) of 5,000 to 400,000.

Examples of a quantitative method of functional groups in a resin include the titration of carboxyl groups with potassium hydroxide; the titration of amino groups with sodium nitrite; the titration of hydroxy groups with acetic anhydride and potassium hydroxide; the titration of thiol groups with 5,5'-dithiobis(2-nitrobenzoic acid); and a calibration curve method using a calibration curve obtained from IR spectra of samples having different polymerizable functional group contents.

Table 12 describes specific examples of resin D. In Table 12, the column "Characteristic structure" indicates the structural units represented by the formulae (E-1) to (E-5).

TABLE 12

| | Structure unit | | | Number of moles of functional group per | Characteristic | weight-average molecular |
|---|---|---|---|---|---|---|
| | $R^{61}$ | $Y^1$ | $W^1$ | gram | structure | weight |
| D1 | H | single bond | OH | 3.3 mmol | butyral | $1 \times 10^5$ |
| D2 | H | single bond | OH | 3.3 mmol | butyral | $4 \times 10^4$ |
| D3 | H | single bond | OH | 3.3 mmol | butyral | $2 \times 10^4$ |
| D4 | H | single bond | OH | 1.0 mmol | polyolefin | $1 \times 10^5$ |
| D5 | H | single bond | OH | 3.0 mmol | ester | $8 \times 10^4$ |
| D6 | H | single bond | OH | 2.5 mmol | polyether | $5 \times 10^4$ |
| D7 | H | single bond | OH | 2.8 mmol | cellulose | $3 \times 10^4$ |
| D8 | H | single bond | COOH | 3.5 mmol | polyolefin | $6 \times 10^4$ |
| D9 | H | single bond | $NH_2$ | 1.2 mmol | polyamide | $2 \times 10^5$ |
| D10 | H | single bond | SH | 1.3 mmol | polyolefin | $9 \times 10^3$ |
| D11 | H | phenylene | OH | 2.8 mmol | polyolefin | $4 \times 10^3$ |
| D12 | H | single bond | OH | 3.0 mmol | butyral | $7 \times 10^4$ |
| D13 | H | single bond | OH | 2.9 mmol | polyester | $2 \times 10^4$ |
| D14 | H | single bond | OH | 2.5 mmol | polyester | $6 \times 10^3$ |
| D15 | H | single bond | OH | 2.7 mmol | polyester | $8 \times 10^4$ |
| D16 | H | single bond | COOH | 1.4 mmol | polyolefin | $2 \times 10^5$ |
| D17 | H | single bond | COOH | 2.2 mmol | polyester | $9 \times 10^3$ |
| D18 | H | single bond | COOH | 2.8 mmol | polyester | $8 \times 10^2$ |
| D19 | $CH_3$ | alkylene | OH | 1.5 mmol | polyester | $2 \times 10^4$ |
| D20 | $C_2H_5$ | alkylene | OH | 2.1 mmol | polyester | $1 \times 10^4$ |
| D21 | $C_2H_5$ | alkylene | OH | 3.0 mmol | polyester | $5 \times 10^4$ |
| D22 | H | single bond | $OCH_3$ | 2.8 mmol | polyolefin | $7 \times 10^3$ |
| D23 | H | single bond | OH | 3.3 mmol | butyral | $2.7 \times 10^5$ |
| D24 | H | single bond | OH | 3.3 mmol | butyral | $4 \times 10^5$ |
| D25 | H | single bond | OH | 2.5 mmol | acetal | $3.4 \times 10^5$ |

The second intermediate layer may have a thickness of approximately 0.1 μm or more and 1.5 μm or less, i.e., approximately 0.2 μm or more and 0.7 μm or less from the viewpoint of inhibiting the retention of electrons and further inhibiting the occurrence of the pattern memory. The second intermediate layer may contain roughening particles as an additive. Examples of the roughening particles include curable resin particles and metal oxide particles. In addition, the second intermediate layer may contain an additive, for example, a silicone oil, a surfactant, or a silane compound.

Examples of a solvent used for the second intermediate layer coating liquid include alcohol-based solvents, aromatic hydrocarbon-based solvents, halogenated hydrocarbon-based solvents, ketone-based solvents, ketone alcohol-based solvents, ether-based solvents, and ester-based solvents.

Conductive Support

As the conductive support, a conductive support composed of a metal, for example, aluminum, nickel, copper, gold, or iron, or an alloy may be used. Examples of the conductive support include a support in which a thin film composed of a metal, for example, aluminum, silver, or gold is formed on an insulating support composed of, for example, a polyester resin, a polycarbonate resin, a polyimide resin, or glass; and a support in which a thin film composed of a conductive material, for example, indium oxide or tin oxide, is formed on the insulating support.

A surface of the conductive support may be subjected to electrochemical treatment, such as anodic oxidation, or a process, for example, wet honing, blasting, or cutting in order to improve the electric characteristics and inhibit the occurrence of interference fringes.

First Intermediate Layer and Second Intermediate Layer

The first intermediate layer and the second intermediate layer are as described above.

Charge Generating Layer

The charge generating layer is formed on the second intermediate layer.

Examples of a charge generating material include azo pigments, perylene pigments, anthraquinone derivatives, anthanthrone derivatives, dibenzopyrenequinone derivatives, pyranthrone derivatives, violanthrone derivatives, isoviolanthrone derivatives, indigo derivatives, thioindigo derivatives, phthalocyanine pigments, and bisbenzimidazole derivatives. Of these, azo pigments and phthalocyanine pigments may be used. Among phthalocyanine pigments, oxytitanium phthalocyanine, chlorogallium phthalocyanine, and hydroxygallium phthalocyanine may be used.

Examples of a binder resin used for the charge generating layer include polymers and copolymers of vinyl compounds, such as styrene, vinyl acetate, vinyl chloride, acrylates, methacrylates, vinylidene fluoride, and trifluoroethylene; polyvinyl alcohol resins; polyvinyl acetal resins; polycarbonate resins; polyester resins; polysulfone resins; polyphenylene oxide resins; polyurethane resins; cellulose resins; phenolic resins; melamine resins; silicone resins; and epoxy resins. Of these, polyester resins, polycarbonate resins, and polyvinyl acetal resins may be used. In particular, polyvinyl acetal resins may be used.

The charge generating layer may be formed by forming a coating film of the charge generating layer coating liquid and drying the coating film, the charge generating layer coating liquid being prepared by the dispersion treatment of the charge generating material, a binder resin, and a solvent. Alternatively, the charge generating layer may be formed by the deposition of the charge generating material.

In the charge generating layer, the ratio by mass of the charge generating material to the binder resin (charge generating material/binder resin) is in the range of approximately 10/1 to 1/10, i.e., approximately 5/1 to 1/5. Examples of the solvent used for the charge generating layer coating liquid include alcohol-based solvents, sulfoxide-based solvents, ketone-based solvents, ether-based solvents, ester-based solvents, and aromatic hydrocarbon solvents.

The charge generating layer may have a thickness of 0.05 μm or more and 5 μm or less.

Hole Transporting Layer

The hole transporting layer is formed on the charge generating layer.

Examples of a hole transporting material include polycyclic aromatic compounds, heterocyclic compounds, hydrazone compounds, styryl compounds, benzidine compounds, triarylamine compounds, and triphenylamine; and polymers having groups derived from these compounds on their main chains or side chains. Of these, triarylamine compounds, benzidine compounds, and styryl compounds may be used.

Examples of the binder resin used for the hole transporting layer include polyester resins, polycarbonate resins, polymethacrylate resins, polyarylate resins, polysulfone resins, and polystyrene resins. Of these, polycarbonate resins and polyarylate resins may be used. The weight-average molecular weight (Mw) of each of the resins may be in the range of 10,000 to 300,000.

In the hole transporting layer, the ratio by mass of the hole transporting material to the binder resin (hole transporting material/binder resin) may be in the range of approximately 10/5 to 5/10, i.e., approximately 10/8 to 6/10.

The hole transporting layer may have a thickness of approximately 3 μm or more and approximately 40 μm. i.e., approximately 5 μm or more and 16 μm or less. Examples of a solvent used for the hole transporting layer coating liquid include alcohol-based solvents, sulfoxide-based solvents, ketone-based solvents, ether-based solvents, ester-based solvents, and aromatic hydrocarbon solvents.

A protective layer may be formed on the hole transporting layer. The protective layer may contain a binder resin, and conductive particles or a charge transporting material. The protective layer may further contain an additive, such as a lubricant. The binder resin itself may have conductivity or hole transportability. In this case, the protective layer may not contain conductive particles or a hole transport material other than the binder resin. The binder resin in the protective layer may be a thermoplastic resin or a cured resin by curing due to heat, light, or radiation (an electron beam). The protective layer may have a thickness of 1 μm or more and 10 μm or less.

As a method for forming each of the layers, a method described below may be employed. That is, coating liquids prepared by dissolving and/or dispersing materials constituting the layers in solvents are applied to form coating films, and the resulting coating films are dried and/or cured to form the layers. Examples of a method for applying a coating liquid include a dip coating method, a spray coating method, a curtain coating method, and a spin coating method.

Process Cartridge and Electrophotographic Apparatus

FIG. 1 illustrates a schematic structure of an electrophotographic apparatus including a process cartridge with an electrophotographic photosensitive member.

The electrophotographic apparatus illustrated in FIG. 1 includes a cylindrical electrophotographic photosensitive member 1, which is rotationally driven around a shaft 2 at a predetermined circumferential velocity in the direction indicated by an arrow. A surface (peripheral surface) of the rotationally driven electrophotographic photosensitive member 1 is charged to a predetermined positive or negative potential with a charging device 3 (primary charging device: charging roller). Then, exposure is performed with exposure light (image exposure light) 4 emitted from an exposure device (not illustrated) employing, for example, slit exposure or laser beam scanning exposure. In this way, an electrostatic latent image corresponding to a target image is formed on the surface of the electrophotographic photosensitive member 1.

The electrostatic latent image formed on the surface of the electrophotographic photosensitive member 1 is then developed with a toner in a developer of a developing device 5 to form a toner image. The toner image formed on the surface of the electrophotographic photosensitive member 1 is sequentially transferred onto a transfer material (paper) P by a transfer bias from a transfer device (transfer roller) 6. The transfer material P is removed from a transfer material feeding unit (not illustrated) in synchronization with the rotation of the electrophotographic photosensitive member 1 and fed to a nip (contact portion) between the electrophotographic photosensitive member 1 and the transfer device 6.

The transfer material P to which the toner image has been transferred is separated from the surface of the electrophotographic photosensitive member 1, conveyed to a fixing device 8, and subjected to fixation of the toner image. The transferred material P is then conveyed as an image formed product (print or copy) to the outside of the apparatus.

The surface of the electrophotographic photosensitive member 1 after the transfer of the toner image, is cleaned by removing the residual developer (untransferred toner) with a cleaning device (cleaning blade) 7. The electrophotographic photosensitive member 1 is subjected to charge elimination by pre-exposure light (not illustrated) emitted from a pre-exposure device (not illustrated) and then is repeatedly used for image formation. As illustrated in FIG. 1, in the case where the charging device 3 is a contact charging device using, for example, a charging roller, the pre-exposure light is not always required.

Plural components selected from the components, such as the electrophotographic photosensitive member 1, the charging device 3, the developing device 5, the transfer device 6, and the cleaning device 7, may be arranged in a housing and integrally connected into a process cartridge. The process cartridge may be detachably attached to the main body of an electrophotographic apparatus, for example, a copier or laser beam printer. In FIG. 1, the electrophotographic photosensitive member 1, the charging device 3, the developing device 5, and the cleaning device 7 are integrally supported into a process cartridge 9 detachably attached to the main body of the electrophotographic apparatus using a guiding member 10, such as a rail.

EXAMPLES

Synthesis Example 1

To a 300-mL three-necked flask, 26.8 g (100 mmol) of 1,4,5,8-naphthalenetetracarboxylic dianhydride and 150 mL of dimethylacetamide were added at room temperature under a stream of nitrogen. A mixture of 8.9 g (100 mmol) of butanolamine and 25 mL of dimethylacetamide was added dropwise thereto under stirring. After the completion of the dropwise addition, the resulting mixture was heated to reflux for 6 hours. After the completion of the reflux, the vessel was cooled. The mixture was concentrated under reduced pressure. Ethyl acetate was added to the resulting residue. The resulting mixture was purified by silica-gel column chromatography. The purified product was recrystallized in ethyl acetate/hexane to give 10.2 g of a monoimide product containing a butanol structure only on a side.

Into a 300-mL three-necked flask, 6.8 g (20 mmol) of the monoimide product, 1 g (20 mmol) of hydrazine monohydrate, 10 mg of p-toluenesulfonic acid, and 50 mL of toluene were charged. The resulting mixture was heated to reflux for 5 hours. After the completion of the reflux by heating, the vessel was cooled. The mixture was concentrated under reduced pressure. The resulting residue was purified by silica-gel column chromatography. The purified product was recrystallized in toluene/ethyl acetate to give 2.54 g of a compound (electron transporting material) represented by the formula (A1101).

Synthesis Example 2

In a 500-mL three-necked flask, 23.4 g (100 mmol) of a compound represented by the formula (X-1) and 15.2 g (100 mmol) of a compound represented by the formula (X-2) were dissolved in 200 mL of tetrahydrofuran at room temperature under a stream of nitrogen. The solution was heated to 60° C. and refluxed for 6 hours. After the completion of the reflux, the vessel was cooled. The reaction mixture was then filtered. The filtrate was concentrated to give 30 g of crude crystals. The resulting crystals were recrystallized in acetone. The crystals were dried under reduced pressure to give 25.8 g of a compound represented by the formula (X-3). As the compound represented by the formula (X-1), 3,5-di-tert-butyl-4-hydroxybenzaldehyde (available from Tokyo Chemical Industry Co., Ltd.) was used. As the compound represented by the formula (X-2), 4-hydrazinobenzoic acid (available from Sigma-Aldrich Japan K.K.) was used.

In a 500-mL three-necked flask, 23.2 g (63 mmol) of the compound represented by the formula (X-3) was dissolved in 200 mL of chloroform. Then 18.5 g (117 mmol) of potassium permanganate was added thereto. The mixture was heated to 52° C. and stirred at the temperature for 5 hours. The reaction mixture was filtered. The filtrate was concentrated to give 25.6 g of crude crystals. The resulting crystals were recrystallized in acetone. The crystals were dried under reduced pressure to give 22.0 g of a compound represented by the formula (X-4).

In a 500-mL three-necked flask, 18.3 g (50 mmol) of the compound represented by the formula (X-4) was dissolved in 200 mL of tetrahydrofuran. Then 1.89 g (50 mmol) of sodium borohydride and 11.7 g (50 mmol) of zirconium chloride were added thereto. The mixture was heated to 52° C. and stirred at the temperature for 5 hours. The reaction mixture was filtered. The filtrate was concentrated to give 15.3 g of crude crystals. The resulting crystals were recrystallized in acetone. The crystals were dried under reduced pressure to give 14.1 g of exemplified compound (A1001).

(X-1)

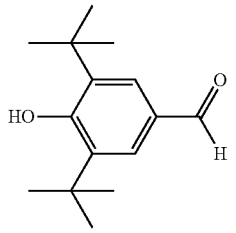

(X-2)

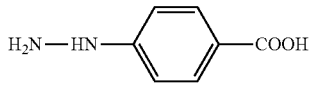

(X-3)

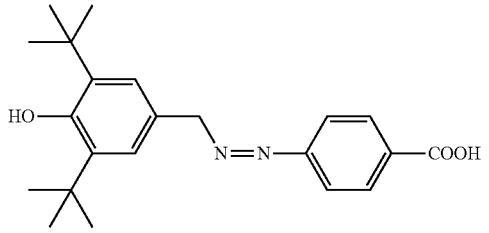

(X-4)

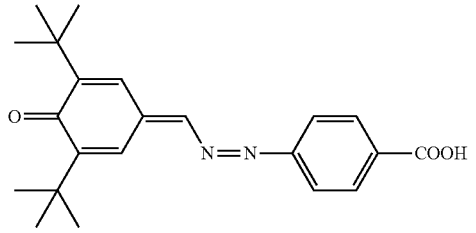

-continued (A1001)

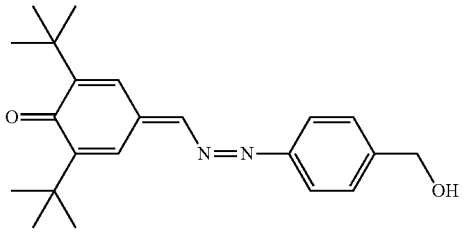

A preparation example of a first intermediate layer coating liquid used to form a first intermediate layer will be described below. The term "parts" indicates "parts by mass".

First Intermediate Layer Coating Liquid 1

First, 100 parts of zinc oxide particles (manufactured by Tayca Corporation, average particle diameter: 70 nm, specific surface area: 15 m2/g) were mixed with 500 parts of toluene under stirring. Then 1.25 parts of N-2-(aminoethyl)-3-aminopropyltrimethoxysilane (trade name: KBM-603, manufactured by Shin-Etsu Chemical Co., Ltd.) was added thereto. The mixture was stirred for 2 hours. Toluene was removed by distillation under reduced pressure. Baking was performed at 120° C. for 3 hours to provide zinc oxide particles M1 whose surfaces had been treated with the silane coupling agent.

Next, 15 parts of polyvinyl acetal resin (trade name: BM-1, manufactured by Sekisui Chemical Co., Ltd.) and 13.5 parts of a blocked isocyanate compound (trade name: Sumijule 3173, manufactured by Sumika Bayer Urethane Co., Ltd.) were dissolved in 85 parts of methyl ethyl ketone. To the solution, 60 parts of zinc oxide particles M1 and 0.6 parts of 1,2-dihydorxyanthraquinone (manufactured by Tokyo Chemical Industry Co., Ltd.) were added. Dispersion treatment was performed at 23±3° C. in an atmosphere for 4 hours using a sand mill together with glass beads 1 mm in diameter. After the completion of the dispersion treatment, 0.005 parts of dioctyltin dilaurate (serving as a catalyst) and 4.0 parts of silicone resin particles (trade name: Tospearl 145, manufactured by Momentive Performance Materials Inc.) were added thereto. The mixture was stirred to prepare first intermediate layer coating liquid 1.

First Intermediate Layer Coating Liquid 2

Titanium oxide particles N1 whose surfaces had been treated with a silane coupling agent were prepared as in the description of first intermediate layer coating liquid 1, except that titanium oxide particles (trade name: CR-EL, manufactured by Ishihara Sangyo Kaisha, Ltd., average particle diameter: 250 nm) were used in place of the zinc oxide particles used in first intermediate layer coating liquid 1.

Next, 6 parts of an alkyd resin (trade name: BECKOLITE M-6401-50, manufactured by DIC Corporation) and 4 parts of a melamine resin (trade name: SUPER BECKAMIN G-821-60, manufactured by DIC Corporation) were dissolved in 50 parts of 2-butanone. To the solution, 60 parts of titanium oxide particles N1 were added. Dispersion treatment was performed at 23±3° C. in an atmosphere for 1 hour using a sand mill together with zirconia beads 2 mm in diameter to prepare first intermediate layer coating liquid 2.

First Intermediate Layer Coating Liquid 3

First, 100 parts of titanium oxide particles (CR-EL) were mixed with 500 parts of toluene under stirring. Next, 1.25 parts of 1-aminododecane (available from Sigma-Aldrich) was added thereto. The mixture was stirred for 2 hours. Toluene was removed by distillation under reduced pressure. Baking was performed at 120° C. for 3 hours to provide titanium oxide particles N2 whose surfaces had been treated with the amino group-containing compound.

Next, first intermediate layer coating liquid 3 was prepared as in first intermediate layer coating liquid 2, except that titanium oxide particles N2 were used as the metal oxide particles.

First Intermediate Layer Coating Liquid 4

First, 100 parts of titanium oxide particles (CR-EL) were mixed with 500 parts of toluene under stirring. Next, 1.25 parts of 1,2-epoxydodecane (available from Sigma-Aldrich) was added thereto. The mixture was stirred for 2 hours. Toluene was removed by distillation under reduced pressure. Baking was performed at 120° C. for 3 hours to provide titanium oxide particles N3 whose surfaces had been treated with the epoxy group-containing compound.

Next, first intermediate layer coating liquid 4 was prepared as in first intermediate layer coating liquid 2, except that titanium oxide particles N3 were used as the metal oxide particles.

First Intermediate Layer Coating Liquid 5

First, 100 parts of titanium oxide particles (CR-EL) were mixed with 500 parts of toluene under stirring. Next, 1.25 parts of undecanoic acid (available from Sigma-Aldrich) was added thereto. The mixture was stirred for 2 hours. Toluene was removed by distillation under reduced pressure. Baking was performed at 120° C. for 3 hours to provide titanium oxide particles N4 whose surfaces had been treated with the carboxy group-containing compound.

Next, first intermediate layer coating liquid 5 was prepared as in first intermediate layer coating liquid 2, except that titanium oxide particles N4 were used as the metal oxide particles.

First Intermediate Layer Coating Liquid 6

First, 100 parts of titanium oxide particles (CR-EL) were mixed with 500 parts of toluene under stirring. Next, 1.25 parts of 1-hexadecanol (manufactured by Tokyo Chemical Industry Co., Ltd.) was added thereto. The mixture was stirred for 2 hours. Toluene was removed by distillation under reduced pressure. Baking was performed at 120° C. for 3 hours to provide titanium oxide particles N5 whose surfaces had been treated with the hydroxy group-containing compound.

Next, first intermediate layer coating liquid 6 was prepared as in first intermediate layer coating liquid 2, except that titanium oxide particles N5 were used as the metal oxide particles.

First Intermediate Layer Coating Liquid 7

First, 100 parts of titanium oxide particles (CR-EL) were mixed with 500 parts of toluene under stirring. Next, 1.25 parts of 1-dodecanethiol (manufactured by Tokyo Chemical Industry Co., Ltd.) was added thereto. The mixture was stirred for 2 hours. Toluene was removed by distillation under reduced pressure. Baking was performed at 120° C. for 3 hours to provide titanium oxide particles N6 whose surfaces had been treated with the thiol group-containing compound.

Next, first intermediate layer coating liquid 7 was prepared as in first intermediate layer coating liquid 2, except that titanium oxide particles N6 were used as the metal oxide particles.

First Intermediate Layer Coating Liquid 8

First intermediate layer coating liquid 8 was prepared as in first intermediate layer coating liquid 1, except that 1,2-dihydroxyanthraquinone was not incorporated.

First Intermediate Layer Coating Liquid 9

First intermediate layer coating liquid 9 was prepared as in first intermediate layer coating liquid 1, except that 45 parts of zinc oxide particles M1 were used as the metal oxide particles.

First Intermediate Layer Coating Liquid 10

First intermediate layer coating liquid 10 was prepared as in first intermediate layer coating liquid 1, except that 70 parts of zinc oxide particles M1 were used as the metal oxide particles.

First Intermediate Layer Coating Liquid 11

First, 100 parts of zinc oxide particles (manufactured by Tayca Corporation, average particle diameter: 70 nm, specific surface area: 15 m2/g) were mixed with 500 parts of toluene under stirring. Then 1.25 parts of 3-methacryloxypropyltrimethoxysilane (trade name: KBM-503, manufactured by Shin-Etsu Chemical Co., Ltd.) was added thereto. The mixture was stirred for 2 hours. Toluene was removed by distillation under reduced pressure. Baking was performed at 120° C. for 3 hours to provide zinc oxide particles M2 whose surfaces had been treated with the silane coupling agent.

First intermediate layer coating liquid 11 was prepared as in first intermediate layer coating liquid 1, except that zinc oxide particles M2 were used as the metal oxide particles.

First Intermediate Layer Coating Liquid 12

First, 100 parts of zinc oxide particles (manufactured by Tayca Corporation, average particle diameter: 70 nm, specific surface area: 15 m2/g) were mixed with 500 parts of toluene under stirring. Then 1.25 parts of p-styryltrimethoxysilane (trade name: KBM-1403, manufactured by Shin-Etsu Chemical Co., Ltd.) was added thereto. The mixture was stirred for 2 hours. Toluene was removed by distillation under reduced pressure. Baking was performed at 120° C. for 3 hours to provide zinc oxide particles M3 whose surfaces had been treated with the silane coupling agent.

First intermediate layer coating liquid 12 was prepared as in first intermediate layer coating liquid 1, except that zinc oxide particles M3 were used as the metal oxide particles.

Next, 4 parts of electron transporting material (A101), 5.5 parts of a crosslinking agent [B1:protective group (H1)=5.1:2.2 (mass ratio)], 0.3 parts of resin (D1), and 0.05 parts of a catalyst (dioctyltin laurate) were dissolved in a solvent mixture of 100 parts of dimethylacetamide and 100 parts of methyl ethyl ketone to prepare a second intermediate layer coating liquid. The second intermediate layer coating liquid was applied to the first intermediate layer by dipping to form a coating film. The coating film was cured (polymerized) by heating at 160° C. for 40 minutes to form a second intermediate layer having a thickness of 0.26 μm. Thereby, a laminated body including the conductive support, the first intermediate layer, and the second intermediate layer was formed. The content of the electron transporting material was 41% by mass with respect to the total mass of the electron transporting material, the crosslinking agent, and the resin. Regarding resin (D1), in the formula (E-1) in which the characteristic structure is butyral, R201 represents $C_3H_7$.

Next, 10 parts of hydroxygallium phthalocyanine crystals (charge generating material) that exhibit peaks at Bragg angles (2θ±0.2°) of 7.5°, 9.9°, 12.5°, 16.3°, 18.6°, 25.1°, and 28.3° in X-ray diffraction with CuKα characteristic radiation were prepared. This charge generating material, 0.1 parts of a compound represented by the formula (17), 5 parts of polyvinyl butyral (trade name: S-LEC BX-1, manufactured by Sekisui Chemical Co., Ltd.), and 250 parts of cyclohexanone were charged into a sand mill together with glass beads 0.8 mm in diameter. The mixture was subjected to dispersion treatment for 1.5 hours. Then 250 parts of ethyl acetate was added to the resulting dispersion to prepare a charge generating layer coating liquid. The charge generating layer coating liquid was applied to the second intermediate layer by dipping to form a coating film. The coating film was dried at 100° C. for 10 minutes to form a charge generating layer having a thickness of 0.15 μm.

(17)

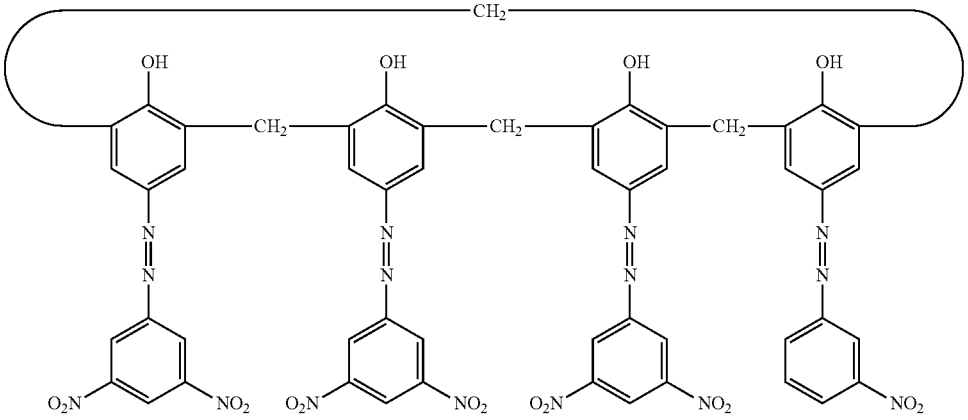

While the present invention will be described in more detail below by examples and comparative examples, the present invention is not limited to these examples. The term "parts" in these examples indicates "parts by mass".

Example 1

An aluminum cylinder (JIS-A3003) having a diameter of 30 mm was used as a conductive support.

The first intermediate layer coating liquid 1 was applied to the conductive support by dipping to form a coating film. The coating film was dried at 180° C. for 40 minutes to form a first intermediate layer having a thickness of 20 μm.

Next, 4 parts of a compound represented by the formula (9-1), 4 parts of a compound represented by the formula (9-2), and 10 parts of bisphenol Z-type polycarbonate (trade name: 2400, manufactured by Mitsubishi Engineering Plastics Corp.) were dissolved in a solvent mixture of 40 parts of dimethoxymethane and 60 parts of chlorobenzene to prepare a hole transporting layer coating liquid. The hole transporting layer coating liquid was applied to the charge generating layer by dipping to form a coating film. The coating film was dried at 120° C. for 40 minutes to form a hole transporting layer having a thickness of 15 μm.

(9-1)

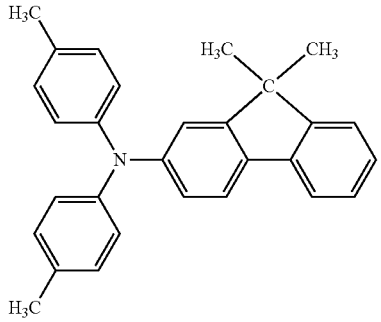

(9-2)

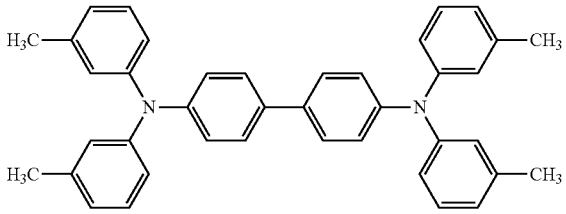

As described above, an electrophotographic photosensitive member for the evaluation of pattern memory was produced, the electrophotographic photosensitive member including the laminated body, and the charge generating layer and the hole transporting layer provided on the laminated body. In addition, another electrophotographic photosensitive member for determination was produced in the same way as above.

Determination Test

The electrophotographic photosensitive member for determination was immersed in a solvent mixture of 40 parts of dimethoxymethane and 60 parts of chlorobenzenze for 5 minutes. Ultrasonic waves were applied thereto to detach the hole transporting layer. Next, the charge generating layer was ground with a lapping tape (C2000, manufactured by Fuji Photo Film Co., Ltd). Then drying was performed at 100° C. for 10 minutes to produce a laminated body including the conductive support, the first intermediate layer, and the second intermediate layer, the laminated body serving as the electrophotographic photosensitive member for determination. It was confirmed that none of the components of the hole transporting layer or the charge generating layer were detected on a surface of the laminated body by a FTIR-ATR method.

Next, a measuring portion of the laminated body was cut out so as to have a size of 2 cm (in the circumferential direction of the electrophotographic photosensitive member)×4 cm (in the longitudinal direction of the electrophotographic photosensitive member). A circular-shaped gold electrode having a thickness of 300 nm and a diameter of 12 mm was deposited by sputtering on a surface of the second intermediate layer. The resulting article was used as a measurement sample.

After the sample had been allowed to stand in an environment with a temperature of 23° C. and a humidity of 50% RH for 24 hours, the determination method was employed. The entire sample was shielded from room light with a blackout curtain. An alternating electric field having a voltage of $3.0\times10^{-3}$ V/μm was applied between the conductive support and the gold electrode while a direct electric field having a voltage of 0 V was applied from the conductive support to the gold electrode. The impedance was measured by sweeping the frequency of the alternating electric field from 1 MHz to 0.1 Hz. In this way, the impedance (R_0V) was measured by applying an alternating electric field having a voltage of $3.0\times10^{-3}$ V/μm and a frequency of 0.1 Hz while a direct electric field having a voltage of 0 V was applied.

Next, a direct electric field having a voltage of −0.3 V/μm was applied from the conductive support to the gold electrode with respect to the total thickness of the first intermediate layer and the second intermediate layer. An alternating electric field having a voltage of $3.0\times10^{-3}$ V/μm was applied between the conductive support and the gold electrode while the direct electric field was applied. The impedance was measured by sweeping the frequency from 1 MHz to 0.1 Hz. In this way, the impedance (R_nV) was measured by applying an alternating electric field having a voltage of $3.0\times10^{-3}$ V/μm and a frequency of 0.1 Hz while a direct electric field having a voltage of −0.3 V/μm was applied with respect to the total thickness of the first intermediate layer and the second intermediate layer. The value of R_nV/R_0V was calculated from the resulting R_0V and R_nV. Table 17 describes the measurement results.

Evaluation of Pattern Memory

The produced electrophotographic photosensitive member for evaluation was mounted on a modified printer of a laser beam printer (trade name: LBP-2510) manufactured by CANON KABUSHIKI KAISHA and then was evaluated. Details are described below.

The produced electrophotographic photosensitive member was mounted on the laser beam printer. This was placed in a low-temperature and low-humidity environment (temperature: 15° C., humidity: 10% RH). Images each having a 3-dot, 100-space longitudinal-line pattern were repeatedly output on 15,000 sheets. Then four types of halftone images and solid black images were output. Longitudinal streaks, serving as the history of the 3-dot, 100-space longitudinal lines, were visually checked on these output images. These images were ranked on a scale of six as described in Table 13. A larger number of the rank indicates a better image in terms of pattern memory. The four types of halftone images include a 1-dot Keima pattern halftone image, a 1-dot, 1-space transverse line halftone image, a 2-dot, 3-space transverse line halftone image, and a 1-dot, 2-space transverse line halftone image.

TABLE 13

| | | Rank of pattern memory | | | | | |
|---|---|---|---|---|---|---|---|
| | | 6 | 5 | 4 | 3 | 2 | 1 |
| Solid black image | | not observed | observed | observed | observed | observed | observed |
| Halftone image | 1-Dot Keima pattern | not observed | not observed | observed | observed | observed | observed |
| | 1-Dot, 1-space transverse line | not observed | not observed | not observed | observed | observed | observed |
| | 2-Dot, 3-space transverse line | not observed | not observed | not observed | not observed | observed | observed |
| | 1-Dot, 2-space transverse line | not observed | not observed | not observed | not observed | not observed | observed |

Evaluation of Leakage

The evaluation of the leakage of the produced electrophotographic photosensitive member for evaluation was performed as described below.

The produced electrophotographic photosensitive member was mounted on the modified laser beam printer manufactured by CANON KABUSHIKI KAISHA. This was placed in a low-temperature and low-humidity environment (temperature: 15° C., humidity: 10% RH). Images each having a 3-dot, 100-space longitudinal-line pattern were repeatedly formed on 15,000 sheets. A 1-dot Keima pattern halftone image was output on one sheet at the time of each point: at the time of the start of the repeating image output of 15,000 sheets, at the time of the completion of the image output of 7,500 sheets, and at the time of the completion of the image output of 15,000 sheets. The 1-dot Keima pattern halftone images were visually ranked on a scale of A to E according to the following criteria. Table 17 describes the results. The evaluation criteria of the images are described below.

A: An image defect due to the occurrence of leakage is not observed in an image.

B: A small, faint black spot due to the occurrence of leakage is observed in an image.

C: A large, clear black spot due to the occurrence of leakage is observed in an image.

D: A large black spot and a short transverse line due to the occurrence of leakage are observed.

E: A long transverse line due to the occurrence of leakage is observed.

Example 2

An electrophotographic photosensitive member was produced and evaluated as in Example 1, except that the first intermediate layer having a thickness of 3.5 μm was formed by applying the first intermediate layer coating liquid 2 to the conductive support by dipping to form a coating film and drying the coating film at 180° C. for 40 minutes. Table 17 describes the results.

Examples 3 to 12

Electrophotographic photosensitive members were each produced and evaluated as in Example 1, except that the type of first intermediate layer coating liquid and the thickness of the first intermediate layer were changed as described in Table 14. Table 17 describes the results.

Examples 13 to 15

Electrophotographic photosensitive members were each produced and evaluated as in Example 1, except that the thickness of the second intermediate layer was changed from 0.53 μm to 0.35 μm (Example 13), 0.50 μm (Example 14), and 1.05 μm (Example 15). Table 17 describes the results.

Examples 16 to 25

Electrophotographic photosensitive members were each produced and evaluated as in Example 1, except that electron transporting material (A101) in the second intermediate layer of Example 1 was changed to electron transporting materials described in Table 14 and that the thickness of the second intermediate layer was changed as described in Table 14. Table 17 describes the results.

Example 26

An electrophotographic photosensitive member was produced and evaluated as in Example 1, except that the second intermediate layer was formed as described below. Table 17 describes the results.

First, 5 parts of electron transporting material (A101), 1.75 parts of amine compound (C1-3), 2.0 parts of resin (D1), and 0.1 parts of a catalyst (dodecylbenzenesulfonic acid) were dissolved in a solvent mixture of 100 parts of dimethylacetamide and 100 parts of methyl ethyl ketone to prepare a second intermediate layer coating liquid. The second intermediate layer coating liquid was applied to the first intermediate layer by dipping to form a coating film. The coating film was cured by heating at 160° C. for 40 minutes to form a second intermediate layer having a thickness of 0.70 μm. The content of the electron transporting material was 57% by mass with respect to the total mass of the electron transporting material, the crosslinking agent, and the resin.

Examples 27 to 29

Electrophotographic photosensitive members were each produced and evaluated as in Example 26, except that the thickness of the second intermediate layer was changed from 0.70 μm to 0.35 μm (Example 27), 0.50 μm (Example 28), and 1.00 μm (Example 29). Table 17 describes the results.

Examples 30 to 39

Electrophotographic photosensitive members were each produced and evaluated as in Example 26, except that the electron transporting material of Example 26 was changed from electron transporting material (A101) to electron transporting materials described in Table 14 and the thickness of the second intermediate layer was changed as described in Table 14. Table 17 describes the results.

Example 40

An electrophotographic photosensitive member was produced and evaluated as in Example 1, except that the second intermediate layer was formed as described below. Table 17 describes the results.

First, 4.0 parts of electron transporting material (A101), 5.8 parts of a crosslinking agent [B1:protective group (H1)=5.1:2.2 (mass ratio)], 0.05 parts of a catalyst (dioctyltin laurate) were dissolved in a solvent mixture of 100 parts of dimethylacetamide and 100 parts of methyl ethyl ketone to prepare a second intermediate layer coating liquid. The second intermediate layer coating liquid was applied to the first intermediate layer by dipping to form a coating film. The coating film was cured by heating at 160° C. for 40 minutes to form a second intermediate layer having a thickness of 0.26 μm.

The content of the electron transporting material was 41% by mass with respect to the total mass of the electron transporting material, the crosslinking agent, and the resin.

Examples 41 to 43

Electrophotographic photosensitive members were each produced as in Example 26 and were each evaluated as Example 40, except that the thickness of the second intermediate layer was changed from 0.55 μm to 0.30 μm (Example 41), 0.70 μm (Example 42), and 1.02 μm (Example 43) as described in Table 15. Table 17 describes the results.

Examples 44 to 64

Electrophotographic photosensitive members were each produced and evaluated as in Example 40, except that the electron transporting material was changed as described in Table 15 and that the type of the first intermediate layer coating liquid, the thickness of the first intermediate layer, and the thickness of the second intermediate layer were changed as described in Table 15. Table 17 describes the results.

Example 65

An electrophotographic photosensitive member was produced and evaluated as in Example 1, except that the second intermediate layer was formed as described below. Table 17 describes the results.

First, 5.0 parts of electron transporting material (A101), 3.75 parts of amine compound (C1-3), and 0.1 parts of a catalyst (dodecylbenzenesulfonic acid) were dissolved in a solvent mixture of 100 parts of dimethylacetamide and 100 parts of methyl ethyl ketone to prepare a second intermediate layer coating liquid. The second intermediate layer coating liquid was applied to the first intermediate layer by dipping to form a coating film. The coating film was cured by heating at 160° C. for 40 minutes to form a second intermediate layer having a thickness of 0.45 μm.

The content of the electron transporting material was 57% by mass with respect to the total mass of the electron transporting material, the crosslinking agent, and the resin.

Examples 66 to 68

Electrophotographic photosensitive members were each produced as in Example 15 and were each evaluated as Example 65, except that the thickness of the second intermediate layer was changed from 0.45 μm to 0.30 μm (Example 66), 0.72 μm (Example 67), and 1.10 μm (Example 68). Table 17 describes the results.

Examples 69 to 89

Electrophotographic photosensitive members were each produced and evaluated as in Example 65, except that the electron transporting material was changed to an electron transporting material described in Table 15 and that the type of the first intermediate layer coating liquid, the thickness of the first intermediate layer, and the thickness of the second intermediate layer were changed as described in Table 15. Table 17 describes the results.

Example 90

An electrophotographic photosensitive member was produced and evaluated as in Example 41, except that the charge generating layer was formed as described below. Table 17 describes the results.

First, 10 parts of oxytitanium phthalocyanine (charge generating material) that exhibits strong peaks at Bragg angles (2θ±0.2°) of 9.0°, 14.2°, 23.9°, and 27.1° in X-ray diffraction with CuKα characteristic radiation was prepared. This charge generating material and a polyvinyl butyral resin (S-LEC BX-1) were dissolved in a cyclohexanone/water (97:3) solvent mixture to prepare 166 parts of 5% by mass solution. This solution and 150 parts of the cyclohexanone/water (97:3) solvent mixture were subjected to dispersion treatment using a sand mill together with 400 parts of glass beads 1 mm in diameter for 4 hours. Then 210 parts of the cyclohexanone/water (97:3) solvent mixture and 260 parts of cyclohexanone were added thereto to prepare a charge generating layer coating liquid. The charge generating layer coating liquid was applied to the second intermediate layer by dipping to form a coating film. The coating film was dried at 80° C. for 10 minutes to form a charge generating layer having a thickness of 0.20 μm.

Example 91

An electrophotographic photosensitive member was produced and evaluated as in Example 41, except that the charge generating layer was formed as described below. Table 17 describes the results.

First, 20 parts of a bisazo pigment represented by the formula (11) and 10 parts of a polyvinyl butyral resin (S-LEC BX-1) were dispersed in 150 parts of tetrahydrofuran under stirring to prepare a charge generating layer coating liquid. The resulting coating liquid was applied to the electron transporting layer by dipping to form a coating film. The coating film was dried at 110° C. for 30 minutes to form a charge generating layer having a thickness of 0.30 μm.

(11)

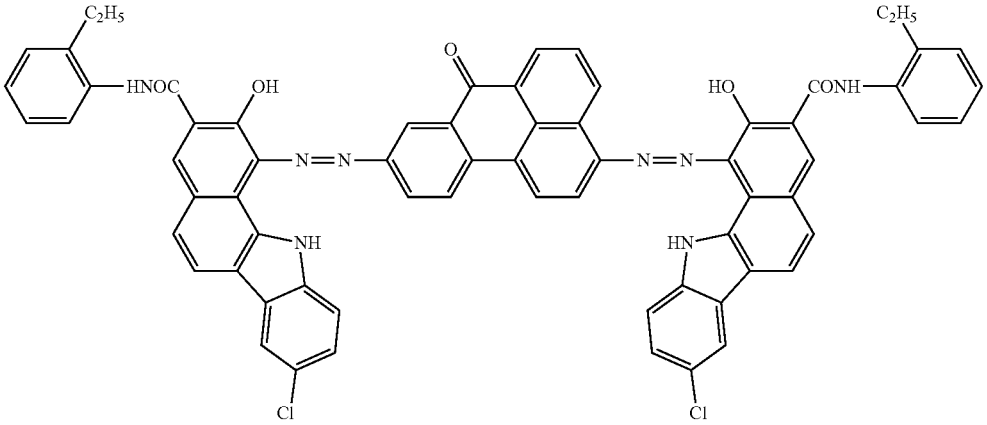

Example 92

An electrophotographic photosensitive member was produced and evaluated as in Example 41, except that a styryl compound (hole transporting material) represented by the formula (9-3) was used in place of the benzidine compound represented by the formula (9-2) in Example 1. Table 17 describes the results.

(9-3)

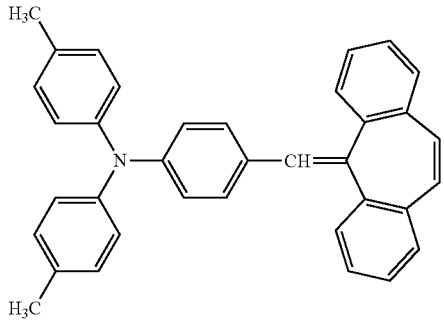

Comparative Example 1

An electrophotographic photosensitive member was produced and evaluated as in Example 1, except that the second intermediate layer was formed as described below. Table 17 describes the results.

First, 2.4 parts of electron transporting material (A101), 4.2 parts of an isocyanate compound [B1:protective group (H1)=5.1:2.2 (mass ratio)], 5.4 parts of resin (D1), and 0.05 parts of a catalyst (dioctyltin laurate) were dissolved in a solvent mixture of 100 parts of dimethylacetamide and 100 parts of methyl ethyl ketone to prepare a second intermediate layer coating liquid. The second intermediate layer coating liquid was applied to the first intermediate layer by dipping to form a coating film. The coating film was cured by heating at 160° C. for 40 minutes to form a second intermediate layer having a thickness of 0.26 μm.

Comparative Example 2

An electrophotographic photosensitive member was produced and evaluated as in Example 1, except that the second intermediate layer was formed as described below. Table 17 describes the results.

First, 3.2 parts of electron transporting material (A101), 5 parts of an isocyanate compound [B1:protective group (H1)=5.1:2.2 (mass ratio)], 4.2 parts of resin (D1), and 0.05 parts of a catalyst (dioctyltin laurate) were dissolved in a solvent mixture of 100 parts of dimethylacetamide and 100 parts of methyl ethyl ketone to prepare a second intermediate layer coating liquid. The second intermediate layer coating liquid was applied to the first intermediate layer by dipping to form a coating film. The coating film was cured by heating at 160° C. for 40 minutes to form a second intermediate layer having a thickness of 0.26 μm.

Comparative Examples 3 and 4

Electrophotographic photosensitive members were each produced and evaluated as in Comparative Example 2, except that the thickness of the second intermediate layer was changed to 0.40 μm (Comparative Example 3) and 1.00 μm (Comparative Example 4). Table 17 describes the results.

Comparative Examples 5 to 8

Electrophotographic photosensitive members were each produced and evaluated as in Example 1, except that the thickness of the second intermediate layer was changed to 1.25 μm (Comparative Example 5), 1.40 μm (Comparative Example 6), 1.50 μm (Comparative Example 7), and 2.00 μm (Comparative Example 8). Table 17 describes the results.

Comparative Example 9

An electrophotographic photosensitive member was produced and evaluated as in Example 1, except that the second intermediate layer was formed as described below. Table 17 describes the results.

First, 4 parts of electron transporting material (A225), 3 parts of hexamethylene diisocyanate, and 4 parts of resin (D1) were dissolved in a solvent mixture of 100 parts of dimethylacetamide and 100 parts of methyl ethyl ketone to prepare a second intermediate layer coating liquid. The second intermediate layer coating liquid was applied to the first intermediate layer by dipping to form a coating film. The coating film was cured by heating at 160° C. for 40 minutes to form a second intermediate layer having a thickness of 1.00 μm.

Comparative Example 10

An electrophotographic photosensitive member was produced and evaluated as in Example 1, except that the second intermediate layer was formed as described below. Table 17 describes the results.

First, 5 parts of electron transporting material (A124), 2.5 parts of 2,4-toluene diisocyanate, and 2.5 parts of poly(p-hydroxystyrene) (trade name: MARUKA LYNCUR, manufactured by Maruzen Petrochemical Co., Ltd.) were dissolved in a solvent mixture of 100 parts of dimethylacetamide and 100 parts of methyl ethyl ketone to prepare a second intermediate layer coating liquid. The second intermediate layer coating liquid was applied to the first intermediate layer by dipping to form a coating film. The coating film was cured by heating at 160° C. for 40 minutes to form a second intermediate layer having a thickness of 0.40 μm.

Comparative Example 11

An electrophotographic photosensitive member was produced and evaluated as in Example 1, except that the second intermediate layer was formed as described below. Table 17 describes the results.

First, 7 parts of electron transporting material (A124), 2 parts of 2,4-toluene diisocyanate, and 1 part of poly(p-hydroxystyrene) were dissolved in a solvent mixture of 100 parts of dimethylacetamide and 100 parts of methyl ethyl ketone to prepare a second intermediate layer coating liquid. The second intermediate layer coating liquid was applied to the first intermediate layer by dipping to form a coating film. The coating film was cured by heating at 160° C. for 40 minutes to form a second intermediate layer having a thickness of 0.40 μm.

Comparative Example 12

An electrophotographic photosensitive member was produced and evaluated as in Example 1, except that antimony-doped tin oxide fine particles (trade name: SN100D, manufactured by Ishihara Sangyo Kaisha, Ltd.) were used to prepare a first intermediate layer coating liquid in place of the surface-treated zinc oxide particles in the first intermediate layer coating liquid 1, the first intermediate layer having a thickness of 6 μm was formed with the resulting first intermediate layer coating liquid, and the second intermediate layer was formed as described below. Table 17 describes the results.

A second intermediate layer having a thickness of 0.32 μm was formed with a block copolymer represented by the following structural formula, a blocked isocyanate, and a vinyl chloride-vinyl acetate copolymer.

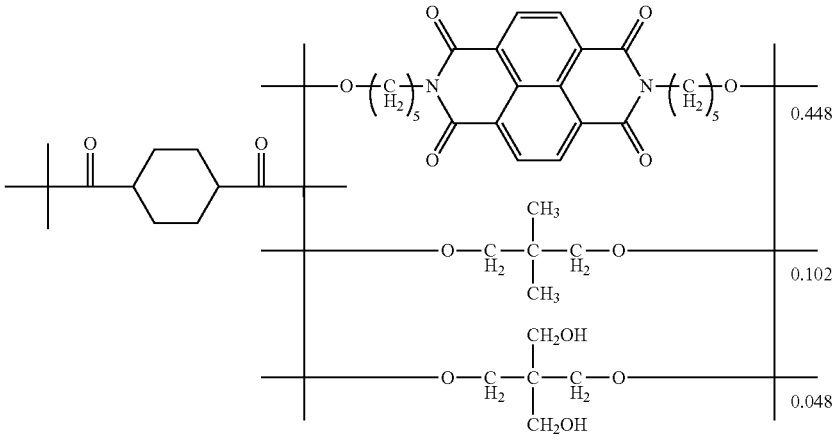

Comparative Example 13

An electrophotographic photosensitive member was produced and evaluated as in Example 1, except that the first intermediate layer having a thickness of 25 μm was formed with first intermediate layer coating liquid 1 and that the second intermediate layer was formed as described below. Table 17 describes the results.

First, 5 parts of alizarin (compound name: 1,2-dihydroxyanthraquinone, manufactured by Wako Pure Chemical Industries, Ltd.), 13.5 parts of a crosslinking agent [B1:protective group (H1)=5.1:2.2 (mass ratio)], 10 parts of resin (D1), and 0.05 parts of dioctyltin laurate serving as a catalyst were dissolved in a solvent mixture of 100 parts of dimethylacetamide and 100 parts of methyl ethyl ketone to prepare a second intermediate layer coating liquid. The second intermediate layer coating liquid was applied to the first intermediate layer by dipping to form a coating film. The coating film was cured by heating at 160° C. for 40 minutes to form a second intermediate layer having a thickness of 1.00 μm.

TABLE 14

| | First intermediate layer | | | Second intermediate layer | | | | |
|---|---|---|---|---|---|---|---|---|
| Example | Type of first intermediate layer coating liquid | Thickness/ μm | Volume resistivity/ Ωcm | Electron transporting material | Crosslinking agent | Resin | Content of electron transporting material | Thickness/ μm |
| 1 | 1 | 20 | $3.2 \times 10^{13}$ | A101 | B1:H1 | D1 | 41% | 0.26 |
| 2 | 2 | 3.5 | $5.2 \times 10^{11}$ | A101 | B1:H1 | D1 | 41% | 0.26 |
| 3 | 3 | 3.5 | $5.0 \times 10^{11}$ | A101 | B1:H1 | D1 | 41% | 0.26 |
| 4 | 4 | 3.5 | $5.5 \times 10^{11}$ | A101 | B1:H1 | D1 | 41% | 0.26 |
| 5 | 5 | 3.5 | $5.2 \times 10^{11}$ | A101 | B1:H1 | D1 | 41% | 0.26 |
| 6 | 6 | 3.5 | $5.0 \times 10^{11}$ | A101 | B1:H1 | D1 | 41% | 0.26 |
| 7 | 7 | 3.5 | $5.2 \times 10^{11}$ | A101 | B1:H1 | D1 | 41% | 0.26 |
| 8 | 8 | 20 | $5.5 \times 10^{13}$ | A101 | B1:H1 | D1 | 41% | 0.26 |
| 9 | 9 | 20 | $3.1 \times 10^{14}$ | A101 | B1:H1 | D1 | 41% | 0.26 |
| 10 | 10 | 20 | $3.7 \times 10^{11}$ | A101 | B1:H1 | D1 | 41% | 0.26 |
| 11 | 11 | 20 | $2.2 \times 10^{13}$ | A101 | B1:H1 | D1 | 41% | 0.26 |
| 12 | 12 | 20 | $2.0 \times 10^{13}$ | A101 | B1:H1 | D1 | 41% | 0.26 |
| 13 | 1 | 20 | $3.2 \times 10^{13}$ | A101 | B1:H1 | D1 | 41% | 0.35 |
| 14 | 1 | 20 | $3.2 \times 10^{13}$ | A101 | B1:H1 | D1 | 41% | 0.50 |

TABLE 14-continued

| | First intermediate layer | | | Second intermediate layer | | | | |
|---|---|---|---|---|---|---|---|---|
| Example | Type of first intermediate layer coating liquid | Thickness/ μm | Volume resistivity/ Ωcm | Electron transporting material | Crosslinking agent | Resin | Content of electron transporting material | Thickness/ μm |
| 15 | 1 | 20 | $3.2 \times 10^{13}$ | A101 | B1:H1 | D1 | 41% | 1.05 |
| 16 | 1 | 20 | $3.2 \times 10^{13}$ | A204 | B1:H1 | D1 | 41% | 0.26 |
| 17 | 1 | 20 | $3.2 \times 10^{13}$ | A304 | B1:H1 | D1 | 41% | 0.26 |
| 18 | 1 | 20 | $3.2 \times 10^{13}$ | A405 | B1:H1 | D1 | 41% | 0.26 |
| 19 | 1 | 20 | $3.2 \times 10^{13}$ | A504 | B1:H1 | D1 | 41% | 0.26 |
| 20 | 1 | 20 | $3.2 \times 10^{13}$ | A605 | B1:H1 | D1 | 41% | 0.26 |
| 21 | 1 | 20 | $3.2 \times 10^{13}$ | A705 | B1:H1 | D1 | 41% | 0.26 |
| 22 | 1 | 20 | $3.2 \times 10^{13}$ | A803 | B1:H1 | D1 | 41% | 0.26 |
| 23 | 1 | 20 | $3.2 \times 10^{13}$ | A903 | B1:H1 | D1 | 41% | 0.26 |
| 24 | 1 | 20 | $3.2 \times 10^{13}$ | A1001 | B1:H1 | D1 | 41% | 0.26 |
| 25 | 1 | 20 | $3.2 \times 10^{13}$ | A1101 | B1:H1 | D1 | 41% | 0.26 |
| 26 | 1 | 20 | $3.2 \times 10^{13}$ | A101 | C1-3 | D1 | 57% | 0.70 |
| 27 | 1 | 20 | $3.2 \times 10^{13}$ | A101 | C1-3 | D1 | 57% | 0.35 |
| 28 | 1 | 20 | $3.2 \times 10^{13}$ | A101 | C1-3 | D1 | 57% | 0.50 |
| 29 | 1 | 20 | $3.2 \times 10^{13}$ | A101 | C1-3 | D1 | 57% | 1.00 |
| 30 | 1 | 20 | $3.2 \times 10^{13}$ | A204 | C1-3 | D1 | 57% | 0.70 |
| 31 | 1 | 20 | $3.2 \times 10^{13}$ | A304 | C1-3 | D1 | 57% | 0.70 |
| 32 | 1 | 20 | $3.2 \times 10^{13}$ | A405 | C1-3 | D1 | 57% | 0.70 |
| 33 | 1 | 20 | $3.2 \times 10^{13}$ | A504 | C1-3 | D1 | 57% | 0.70 |
| 34 | 1 | 20 | $3.2 \times 10^{13}$ | A605 | C1-3 | D1 | 57% | 0.70 |
| 35 | 1 | 20 | $3.2 \times 10^{13}$ | A705 | C1-3 | D1 | 57% | 0.70 |
| 36 | 1 | 20 | $3.2 \times 10^{13}$ | A803 | C1-3 | D1 | 57% | 0.70 |
| 37 | 1 | 20 | $3.2 \times 10^{13}$ | A903 | C1-3 | D1 | 57% | 0.70 |
| 38 | 1 | 20 | $3.2 \times 10^{13}$ | A1001 | C1-3 | D1 | 57% | 0.70 |
| 39 | 1 | 20 | $3.2 \times 10^{13}$ | A1101 | C1-3 | D1 | 57% | 0.70 |

TABLE 15

| | First intermediate layer | | | Second intermediate layer | | | | |
|---|---|---|---|---|---|---|---|---|
| Example | Type of first intermediate layer coating liquid | Thickness/ μm | Volume resistivity/ Ωcm | Electron transporting material | Crosslinking agent | Resin | Content of electron transporting material | Thickness/ μm |
| 40 | 1 | 20 | $3.2 \times 10^{13}$ | A106 | B1:H1 | — | 41% | 0.55 |
| 41 | 1 | 20 | $3.2 \times 10^{13}$ | A106 | B1:H1 | — | 41% | 0.30 |
| 42 | 1 | 20 | $3.2 \times 10^{13}$ | A106 | B1:H1 | — | 41% | 0.70 |
| 43 | 1 | 20 | $3.2 \times 10^{13}$ | A106 | B1:H1 | — | 41% | 1.02 |
| 44 | 2 | 3.5 | $5.2 \times 10^{11}$ | A106 | B1:H1 | — | 41% | 0.55 |
| 45 | 3 | 3.5 | $5.0 \times 10^{11}$ | A106 | B1:H1 | — | 41% | 0.55 |
| 46 | 4 | 3.5 | $5.5 \times 10^{11}$ | A106 | B1:H1 | — | 41% | 0.55 |
| 47 | 5 | 3.5 | $5.2 \times 10^{11}$ | A106 | B1:H1 | — | 41% | 0.55 |
| 48 | 6 | 3.5 | $5.0 \times 10^{11}$ | A106 | B1:H1 | — | 41% | 0.55 |
| 49 | 7 | 3.5 | $5.2 \times 10^{11}$ | A106 | B1:H1 | — | 41% | 0.55 |
| 50 | 8 | 20 | $5.5 \times 10^{13}$ | A106 | B1:H1 | — | 41% | 0.55 |
| 51 | 9 | 20 | $3.1 \times 10^{14}$ | A106 | B1:H1 | — | 41% | 0.55 |
| 52 | 10 | 20 | $3.7 \times 10^{11}$ | A106 | B1:H1 | — | 41% | 0.55 |
| 53 | 11 | 20 | $2.2 \times 10^{13}$ | A106 | B1:H1 | — | 41% | 0.55 |
| 54 | 12 | 20 | $2.0 \times 10^{13}$ | A106 | B1:H1 | — | 41% | 0.55 |
| 55 | 1 | 20 | $3.2 \times 10^{13}$ | A204 | B1:H1 | — | 41% | 0.55 |
| 56 | 1 | 20 | $3.2 \times 10^{13}$ | A304 | B1:H1 | — | 41% | 0.55 |
| 57 | 1 | 20 | $3.2 \times 10^{13}$ | A405 | B1:H1 | — | 41% | 0.55 |
| 58 | 1 | 20 | $3.2 \times 10^{13}$ | A504 | B1:H1 | — | 41% | 0.55 |
| 59 | 1 | 20 | $3.2 \times 10^{13}$ | A605 | B1:H1 | — | 41% | 0.55 |
| 60 | 1 | 20 | $3.2 \times 10^{13}$ | A705 | B1:H1 | — | 41% | 0.55 |
| 61 | 1 | 20 | $3.2 \times 10^{13}$ | A803 | B1:H1 | — | 41% | 0.55 |
| 62 | 1 | 20 | $3.2 \times 10^{13}$ | A905 | B1:H1 | — | 41% | 0.55 |
| 63 | 1 | 20 | $3.2 \times 10^{13}$ | A1001 | B1:H1 | — | 41% | 0.55 |
| 64 | 1 | 20 | $3.2 \times 10^{13}$ | A1101 | B1:H1 | — | 41% | 0.55 |
| 65 | 1 | 20 | $3.2 \times 10^{13}$ | A106 | C1-3 | — | 57% | 0.45 |
| 66 | 1 | 20 | $3.2 \times 10^{13}$ | A106 | C1-3 | — | 57% | 0.30 |
| 67 | 1 | 20 | $3.2 \times 10^{13}$ | A106 | C1-3 | — | 57% | 0.72 |
| 68 | 1 | 20 | $3.2 \times 10^{13}$ | A106 | C1-3 | — | 57% | 1.10 |
| 69 | 2 | 3.5 | $5.2 \times 10^{11}$ | A106 | C1-3 | — | 57% | 0.45 |
| 70 | 3 | 3.5 | $5.0 \times 10^{11}$ | A106 | C1-3 | — | 57% | 0.45 |
| 71 | 4 | 3.5 | $5.5 \times 10^{11}$ | A106 | C1-3 | — | 57% | 0.45 |
| 72 | 5 | 3.5 | $5.2 \times 10^{11}$ | A106 | C1-3 | — | 57% | 0.45 |
| 73 | 6 | 3.5 | $5.0 \times 10^{11}$ | A106 | C1-3 | — | 57% | 0.45 |
| 74 | 7 | 3.5 | $5.2 \times 10^{11}$ | A106 | C1-3 | — | 57% | 0.45 |

TABLE 15-continued

| | First intermediate layer | | | Second intermediate layer | | | | |
|---|---|---|---|---|---|---|---|---|
| Example | Type of first intermediate layer coating liquid | Thickness/ μm | Volume resistivity/ Ωcm | Electron transporting material | Crosslinking agent | Resin | Content of electron transporting material | Thickness/ μm |
| 75 | 8 | 20 | $5.5 \times 10^{13}$ | A106 | C1-3 | — | 57% | 0.45 |
| 76 | 9 | 20 | $3.1 \times 10^{14}$ | A106 | C1-3 | — | 57% | 0.45 |
| 77 | 10 | 20 | $3.7 \times 10^{11}$ | A106 | C1-3 | — | 57% | 0.45 |
| 78 | 11 | 20 | $2.2 \times 10^{13}$ | A106 | C1-3 | — | 57% | 0.45 |
| 79 | 12 | 20 | $2.0 \times 10^{13}$ | A106 | C1-3 | — | 57% | 0.45 |
| 80 | 1 | 20 | $3.2 \times 10^{13}$ | A204 | C1-3 | — | 57% | 0.45 |
| 81 | 1 | 20 | $3.2 \times 10^{13}$ | A304 | C1-3 | — | 57% | 0.45 |
| 82 | 1 | 20 | $3.2 \times 10^{13}$ | A405 | C1-3 | — | 57% | 0.45 |
| 83 | 1 | 20 | $3.2 \times 10^{13}$ | A504 | C1-3 | — | 57% | 0.45 |
| 84 | 1 | 20 | $3.2 \times 10^{13}$ | A605 | C1-3 | — | 57% | 0.45 |
| 85 | 1 | 20 | $3.2 \times 10^{13}$ | A705 | C1-3 | — | 57% | 0.45 |
| 86 | 1 | 20 | $3.2 \times 10^{13}$ | A803 | C1-3 | — | 57% | 0.45 |
| 87 | 1 | 20 | $3.2 \times 10^{13}$ | A903 | C1-3 | — | 57% | 0.45 |
| 88 | 1 | 20 | $3.2 \times 10^{13}$ | A1001 | C1-3 | — | 57% | 0.45 |
| 89 | 1 | 20 | $3.2 \times 10^{13}$ | A1101 | C1-3 | — | 57% | 0.45 |

TABLE 16

| | First intermediate layer | | | Second intermediate layer | | | | |
|---|---|---|---|---|---|---|---|---|
| Example/Comparative Example | Type of first intermediate layer coating liquid | Thickness/ μm | Volume resistivity/ Ωcm | Electron transporting material | Crosslinking agent | Resin | Content of electron transporting material | Thickness/ μm |
| 90 | 1 | 20 | $3.2 \times 10^{13}$ | A106 | B1:H1 | — | 41% | 0.55 |
| 91 | 1 | 20 | $3.2 \times 10^{13}$ | A106 | B1:H1 | — | 41% | 0.55 |
| 92 | 1 | 20 | $3.2 \times 10^{13}$ | A106 | B1:H1 | — | 41% | 0.55 |
| Comparative Example 1 | 1 | 20 | $3.2 \times 10^{13}$ | A101 | B1:H1 | D1 | 20% | 0.26 |
| Comparative Example 2 | 1 | 20 | $3.2 \times 10^{13}$ | A101 | B1:H1 | D1 | 25% | 0.26 |
| Comparative Example 3 | 1 | 20 | $3.2 \times 10^{13}$ | A101 | B1:H1 | D1 | 25% | 0.40 |
| Comparative Example 4 | 1 | 20 | $3.2 \times 10^{13}$ | A101 | B1:H1 | D1 | 25% | 1.00 |
| Comparative Example 5 | 1 | 20 | $3.2 \times 10^{13}$ | A101 | B1:H1 | D1 | 41% | 1.25 |
| Comparative Example 6 | 1 | 20 | $3.2 \times 10^{13}$ | A101 | B1:H1 | D1 | 41% | 1.40 |
| Comparative Example 7 | 1 | 20 | $3.2 \times 10^{13}$ | A101 | B1:H1 | D1 | 41% | 1.50 |
| Comparative Example 8 | 1 | 20 | $3.2 \times 10^{13}$ | A101 | B1:H1 | D1 | 41% | 2.00 |
| Comparative Example 9 | 1 | 20 | $3.2 \times 10^{13}$ | A206 | hexamethylene diisocyanate | D1 | 36% | 1.00 |
| Comparative Example 10 | 1 | 20 | $3.2 \times 10^{13}$ | A106 | 2,4-toluene diisocyanate | poly(p-hydroxystyrene) | 50% | 0.40 |
| Comparative Example 11 | 1 | 20 | $3.2 \times 10^{13}$ | A106 | 2,5-toluene diisocyanate | poly(p-hydroxystyrene) | 50% | 0.40 |

TABLE 17

| | | | Leakage result | | |
|---|---|---|---|---|---|
| Example | R_nV/ R_0V | Pattern memory | Initial | After output of 7,500 sheets | After output of 15,000 sheets |
| 1 | 0.60 | 5 | A | A | B |
| 2 | 0.60 | 5 | A | A | B |
| 3 | 0.60 | 5 | A | A | B |
| 4 | 0.60 | 5 | A | A | B |
| 5 | 0.60 | 5 | A | A | B |
| 6 | 0.60 | 5 | A | A | B |
| 7 | 0.60 | 5 | A | A | B |
| 8 | 0.60 | 5 | A | A | B |
| 9 | 0.60 | 5 | A | A | B |

TABLE 17-continued

| | | | Leakage result | | |
|---|---|---|---|---|---|
| Example | R_nV/ R_0V | Pattern memory | Initial | After output of 7,500 sheets | After output of 15,000 sheets |
| 10 | 0.60 | 5 | A | A | B |
| 11 | 0.60 | 5 | A | A | B |
| 12 | 0.60 | 5 | A | A | B |
| 13 | 0.65 | 4 | A | A | B |
| 14 | 0.70 | 4 | A | A | B |
| 15 | 0.75 | 4 | A | A | B |
| 16 | 0.60 | 5 | A | A | B |
| 17 | 0.60 | 5 | A | A | B |
| 18 | 0.60 | 5 | A | A | B |

TABLE 17-continued

| Example | R_nV/R_0V | Pattern memory | Leakage result: Initial | After output of 7,500 sheets | After output of 15,000 sheets |
|---|---|---|---|---|---|
| 19 | 0.60 | 5 | A | A | B |
| 20 | 0.60 | 5 | A | A | B |
| 21 | 0.60 | 5 | A | A | B |
| 22 | 0.60 | 5 | A | A | B |
| 23 | 0.60 | 5 | A | A | B |
| 24 | 0.60 | 5 | A | A | B |
| 25 | 0.60 | 5 | A | A | B |
| 26 | 0.50 | 6 | A | A | B |
| 27 | 0.40 | 6 | A | A | B |
| 28 | 0.45 | 6 | A | A | B |
| 29 | 0.55 | 4 | A | A | B |
| 30 | 0.50 | 6 | A | A | B |
| 31 | 0.50 | 6 | A | A | B |
| 32 | 0.50 | 6 | A | A | B |
| 33 | 0.50 | 6 | A | A | B |
| 34 | 0.50 | 6 | A | A | B |
| 35 | 0.50 | 6 | A | A | B |
| 36 | 0.50 | 6 | A | A | B |
| 37 | 0.50 | 6 | A | A | B |
| 38 | 0.50 | 6 | A | A | B |
| 39 | 0.50 | 6 | A | A | B |
| 40 | 0.70 | 4 | A | A | A |
| 41 | 0.60 | 4 | A | A | A |
| 42 | 0.65 | 4 | A | A | A |
| 43 | 0.80 | 4 | A | A | A |
| 44 | 0.70 | 4 | A | A | A |
| 45 | 0.70 | 4 | A | A | A |
| 46 | 0.70 | 4 | A | A | A |
| 47 | 0.70 | 4 | A | A | A |
| 48 | 0.70 | 4 | A | A | A |
| 49 | 0.70 | 4 | A | A | A |
| 50 | 0.70 | 4 | A | A | A |
| 51 | 0.70 | 4 | A | A | A |
| 52 | 0.70 | 4 | A | A | A |
| 53 | 0.70 | 4 | A | A | A |
| 54 | 0.70 | 4 | A | A | A |
| 55 | 0.70 | 4 | A | A | A |
| 56 | 0.70 | 4 | A | A | A |
| 57 | 0.70 | 4 | A | A | A |
| 58 | 0.70 | 4 | A | A | A |
| 59 | 0.70 | 4 | A | A | A |
| 60 | 0.70 | 4 | A | A | A |
| 61 | 0.70 | 4 | A | A | A |
| 62 | 0.70 | 4 | A | A | A |
| 63 | 0.70 | 4 | A | A | A |
| 64 | 0.70 | 4 | A | A | A |
| 65 | 0.45 | 6 | A | A | A |
| 66 | 0.40 | 6 | A | A | A |
| 67 | 0.55 | 5 | A | A | A |
| 68 | 0.75 | 4 | A | A | A |
| 69 | 0.45 | 6 | A | A | A |
| 70 | 0.45 | 6 | A | A | A |
| 71 | 0.45 | 6 | A | A | A |
| 72 | 0.45 | 6 | A | A | A |
| 73 | 0.45 | 6 | A | A | A |
| 74 | 0.45 | 6 | A | A | A |
| 75 | 0.45 | 6 | A | A | A |
| 76 | 0.45 | 6 | A | A | A |
| 77 | 0.45 | 6 | A | A | A |
| 78 | 0.45 | 6 | A | A | A |
| 79 | 0.45 | 6 | A | A | A |
| 80 | 0.45 | 6 | A | A | A |
| 81 | 0.45 | 6 | A | A | A |
| 82 | 0.45 | 6 | A | A | A |
| 83 | 0.45 | 6 | A | A | A |
| 84 | 0.45 | 6 | A | A | A |
| 85 | 0.45 | 6 | A | A | A |
| 86 | 0.45 | 6 | A | A | A |
| 87 | 0.45 | 6 | A | A | A |
| 88 | 0.45 | 6 | A | A | A |
| 89 | 0.45 | 6 | A | A | A |
| 90 | 0.70 | 4 | A | A | A |
| 91 | 0.70 | 4 | A | A | A |
| 92 | 0.70 | 4 | A | A | A |

TABLE 17-continued

| Example | R_nV/R_0V | Pattern memory | Leakage result: Initial | After output of 7,500 sheets | After output of 15,000 sheets |
|---|---|---|---|---|---|
| Comparative Example 1 | 0.85 | 1 | A | A | B |
| Comparative Example 2 | 0.82 | 1 | A | A | B |
| Comparative Example 3 | 0.88 | 1 | A | A | B |
| Comparative Example 4 | 0.91 | 1 | A | A | B |
| Comparative Example 5 | 0.85 | 3 | A | A | B |
| Comparative Example 6 | 0.90 | 2 | A | A | B |
| Comparative Example 7 | 0.95 | 1 | A | A | B |
| Comparative Example 8 | 0.98 | 1 | A | A | B |
| Comparative Example 9 | 0.91 | 1 | A | A | B |
| Comparative Example 10 | 0.88 | 1 | A | A | B |
| Comparative Example 11 | 0.88 | 1 | A | A | B |
| Comparative Example 12 | 0.85 | 3 | A | C | C |
| Comparative Example 13 | 0.90 | 3 | A | B | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-205135 filed Sep. 30, 2013 and No. 2014-171782 filed Aug. 26, 2014, which are hereby incorporated by reference herein in their entirety.

What is claimed is:

1. An electrophotographic photosensitive member comprising:

a laminated body, a charge generating layer on the laminated body, and a hole transporting layer on the charge generating layer, wherein the laminated body comprises:

a conductive support, a first intermediate layer on the conductive support, and comprising a binder resin and a metal oxide particle whose surface has been treated with an organic compound, and a second intermediate layer on the first intermediate layer, and comprising a cured product having electron transportability, wherein the laminated body satisfies the following expression (1):

$$R_nV/R_0V \leq 0.80 \quad (1)$$

where R_nV represents impedance of the laminated body measured by the steps of:

forming, on a surface of the second intermediate layer, a circular-shaped gold electrode having a thickness of approximately 300 nm and a diameter of approximately 12 mm by sputtering, and applying, between the conductive support and the circular-shaped gold electrode, an alternating electric field having a voltage of approximately $3.0\times10^{-3}$ V/μm and a frequency of approximately 0.1 Hz while applying, from the conductive support to the circular-shaped gold electrode, a direct electric field having a voltage approximately −0.3 Vμm, and measuring the impedance, and, R_0V represents impedance of the laminated body measured by the steps of:

forming, on a surface of the second intermediate layer, a circular-shaped gold electrode having a thickness of 300 nm and a diameter of 12 mm by sputtering, applying, between the conductive support and the circular-shaped gold electrode, an alternating electric field having a voltage of approximately $3.0\times10^{-3}$ V/μm and a frequency of 0.1 Hz while applying, from the conductive support to the circular-shaped gold electrode, a direct electric field having a voltage approximately 0 V/μm.

2. The electrophotographic photosensitive member according to claim 1, wherein the laminated body satisfies the following expression (2):

$$0.40 \leq R_nV/R_0V \leq 0.75 \quad (2).$$

3. The electrophotographic photosensitive member according to claim 1, wherein the organic compound is a compound having an alkoxysilyl group, an amino group, an epoxy group, a carboxy group, a hydroxy group, or a thiol group.

4. The electrophotographic photosensitive member according to claim 1, wherein the organic compound is a silane coupling agent.

5. The electrophotographic photosensitive member according to claim 1, wherein the first intermediate layer has a volume resistivity of $1.0\times10^{8}$ Ω·cm or more.

6. The electrophotographic photosensitive member according to claim 1, wherein the first intermediate layer has a volume resistivity of $1.0\times10^{15}$ Ω·cm or less.

7. The electrophotographic photosensitive member according to claim 1, wherein the second intermediate layer has a thickness of 0.2 μm or more and 0.7 μm or less.

8. The electrophotographic photosensitive member according to claim 1, wherein the cured product having electron transportability is a cured product of a composition comprising an electron transporting material having a polymerizable functional group, a crosslinking agent, and/or a resin having a polymerizable functional group.

9. The electrophotographic photosensitive member according to claim 8, wherein the content of the electron transporting material having the polymerizable functional group is approximately 30% by mass or more and approximately 70% by mass or less with respect to the total mass of the composition.

10. The electrophotographic photosensitive member according to claim 8, wherein the crosslinking agent is at least one compound selected from the group consisting of isocyanate compounds, melamine compounds, and guanamine compounds.

11. The electrophotographic photosensitive member according to claim 8, wherein the resin having the polymerizable functional group is a resin having a structural unit represented by the following formula (D):

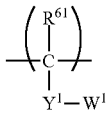

(D)

wherein $R^{61}$ represents a hydrogen atom or an alkyl group, $Y^1$ represents a single bond, an alkylene group, or a phenylene group, and $W^1$ represents a hydroxy group, a thiol group, an amino group, a carboxy group, or a methoxy group.

12. The electrophotographic photosensitive member according to claim 1, wherein the charge generating layer contains at least one charge generating material selected from the group consisting of phthalocyanine pigments and azo pigments.

13. The electrophotographic photosensitive member according to claim 1, wherein the hole transporting layer contains at least one hole transporting material selected from the group consisting of triarylamine compounds, benzidine compounds, and styryl compounds.

14. A process cartridge detachably attachable to a main body of an electrophotographic apparatus, wherein the process cartridge integrally supports the electrophotographic photosensitive member according to claim 1 and at least one device selected from the group consisting of a charging device, a developing device, and a cleaning device.

15. An electrophotographic apparatus comprising:

the electrophotographic photosensitive member according to claim 1;

a charging device;

an exposure device;

a developing device; and a transfer device.

* * * * *